US011649580B1

(12) United States Patent
Tarasova et al.

(10) Patent No.: US 11,649,580 B1
(45) Date of Patent: May 16, 2023

(54) COLLAPSIBLE CLOTHES RACK

(71) Applicant: Honey-Can-Do International, LLC, Berkeley, IL (US)

(72) Inventors: Kristina Tarasova, Arlington Heights, IL (US); Pamela Mical, Brookfield, IL (US); Jeffrey Bull, Naperville, IL (US); Daniel Tagtow, Austin, TX (US); Steve Greenspon, Burr Ridge, IL (US); Alex Hrovat, Lisle, IL (US)

(73) Assignee: Honey-Can-Do International, LLC, Berkeley, IL (US)

( * ) Notice: Subject to any disclaimer, the term of this patent is extended or adjusted under 35 U.S.C. 154(b) by 0 days.

(21) Appl. No.: 17/527,205

(22) Filed: Nov. 16, 2021

(51) Int. Cl.
*D06F 57/08* (2006.01)
*A47B 81/00* (2006.01)
*A47B 43/00* (2006.01)

(52) U.S. Cl.
CPC ..... *D06F 57/08* (2013.01); *A47B 43/00* (2013.01); *A47B 81/00* (2013.01)

(58) Field of Classification Search
CPC ..... D06F 57/08; A47B 43/00; A47B 81/00
USPC ..... 211/198, 201, 202
See application file for complete search history.

(56) References Cited

U.S. PATENT DOCUMENTS 264,000 A * 9/1882 Vanderlip ..... D06F 57/10 5/98.1
288,645 A * 11/1883 Long ..... D06F 57/08 211/198
1,205,205 A * 11/1916 Hoag ..... D06F 57/10 211/202
1,512,867 A * 10/1924 Sutter ..... A47G 19/00 108/190
2,356,930 A * 8/1944 Horstkotte ..... D06F 57/08 211/170
2,388,637 A * 11/1945 John ..... D06F 57/10 211/202
2,924,414 A * 2/1960 Tesdal ..... F16M 11/32 211/206
3,133,645 A * 5/1964 Cecil ..... D06F 57/10 211/202

(Continued)

FOREIGN PATENT DOCUMENTS

DE 2922762 A1 * 12/1980
DE 2922763 A1 * 12/1980

(Continued)

*Primary Examiner* — Stanton L Krycinski
(74) *Attorney, Agent, or Firm* — Adam K. Sacharoff; Much Shelist, P.C.

(57) ABSTRACT

The present invention relates to a collapsible clothes rack. The rack includes a lateral center bar with ends distal to each other, each end being attached to a center hinge assembly. A pair of foldable wing assemblies are attached to the center hinge assemblies and extend transversal to the lateral center bar. A pair of collapsible main leg assemblies are each attached to the center hinge assemblies, and wherein the center hinge assemblies are configured to pivot the main leg assemblies to a predetermined angle from each other to define a base on a surface. Finally, a leg support assembly secured between the pair of collapsible main leg assemblies, and wherein the leg support assembly includes leg support hinges configured to permit the pair of collapsible main leg assembles to pivot away from each other at the predetermined angle.

11 Claims, 30 Drawing Sheets

(56) References Cited

U.S. PATENT DOCUMENTS

| | | | | | |
|---|---|---|---|---|---|
| 4,807,766 | A * | 2/1989 | Compagnucci | D06F 57/08 | 211/198 |
| 4,989,519 | A * | 2/1991 | Welsch | A47B 87/0223 | 248/188 |
| 5,685,442 | A * | 11/1997 | Yoshino | B62B 3/025 | 211/126.1 |
| 6,131,749 | A * | 10/2000 | Crockett | F16M 11/32 | 211/195 |
| 6,282,084 | B1 * | 8/2001 | Goerdt | G06F 1/1656 | 248/676 |
| 7,028,957 | B1 * | 4/2006 | Larson | A47B 13/02 | 248/404 |
| 7,249,741 | B1 * | 7/2007 | Larson | A47B 13/10 | 108/150 |
| 8,100,274 | B2 * | 1/2012 | Trowsdale | D06F 57/08 | 211/195 |
| 8,590,716 | B2 * | 11/2013 | Behjat | D06F 57/08 | 211/198 |
| 9,079,597 | B2 * | 7/2015 | Gonzalez | B62B 3/186 | |
| 9,084,484 | B2 * | 7/2015 | Vilkomirski | A47B 87/0223 | |
| D827,239 | S * | 8/2018 | Xie | D32/58 | |
| 10,344,912 | B1 * | 7/2019 | Angsutrarux | F16M 11/32 | |
| 10,557,227 | B2 * | 2/2020 | Felsenthal | D06F 57/08 | |
| 2007/0012638 | A1 * | 1/2007 | Van Eijk | D06F 57/08 | 211/104 |
| 2013/0228540 | A1 * | 9/2013 | Oh | D06F 57/10 | 211/85.3 |
| 2018/0298547 | A1 * | 10/2018 | Felsenthal | D06F 57/08 | |

FOREIGN PATENT DOCUMENTS

| | | | | |
|---|---|---|---|---|
| EP | 0274360 | A1 * | 7/1988 | |
| EP | 0837175 | A1 * | 4/1998 | |
| EP | 2078785 | A1 * | 7/2009 | D06F 57/08 |
| FR | 2634795 | A1 * | 2/1990 | |
| FR | 3048003 | A1 * | 8/2017 | D06F 57/08 |
| GB | 1554009 | A * | 10/1979 | D06F 57/08 |
| GB | 2020177 | A * | 11/1979 | D06F 57/08 |
| GB | 2560415 | A * | 9/2018 | D06F 57/06 |
| KR | 200409316 | Y1 * | 2/2006 | |
| KR | 200409827 | Y1 * | 3/2006 | |
| KR | 200422982 | Y1 * | 8/2006 | |
| KR | 200441950 | Y1 * | 9/2008 | |
| KR | 20090086775 | A * | 8/2009 | |
| KR | 20090013071 | U * | 12/2009 | |
| KR | 20100010093 | U * | 10/2010 | |
| KR | 20110129026 | A * | 12/2011 | |
| KR | 20120009999 | A * | 2/2012 | |
| KR | 20120032068 | A * | 4/2012 | |
| KR | 101183349 | B1 * | 9/2012 | |
| KR | 20120109273 | A * | 10/2012 | |
| KR | 200464171 | Y1 * | 12/2012 | |
| KR | 20130020111 | A * | 2/2013 | |
| KR | 20140069957 | A * | 6/2014 | |
| KR | 200473791 | Y1 * | 8/2014 | |
| KR | 20140101151 | A * | 8/2014 | |
| KR | 101500984 | B1 * | 3/2015 | |
| WO | WO-2008039086 | A2 * | 4/2008 | D06F 57/06 |

* cited by examiner

COLLAPSIBLE CLOTHES RACK

FIELD OF THE INVENTION

The present invention relates to a clothes rack for hanging clothes and, more particularly, to a collapsible clothes rack.

BACKGROUND OF THE INVENTION

Conventional clothes racks for home use or for use in shops for exhibiting commercial products are commonly made of wooden slats, metal tubes, or plastic members. These conventional clothes racks require much storage space when not in use because they are not collapsible. There are also known detachable clothes racks. When not in use, a detachable clothes rack can be collapsed. However, when the parts of a detachable clothes rack are detached, they must be well kept. If one part of a detachable clothes rack is lost, the detachable clothes rack can no longer be set up again.

Even with the prior part patents and prior designs, improvements are warranted and required to provide for different designs and elements not shown, used, described, or implied in the prior art.

SUMMARY OF THE INVENTION

The present invention relates to a collapsible clothes rack. The folding collapsible clothes rack includes (a) a lateral center bar extending from a front to a back of the clothes rack and having ends distal to each other, each end being attached to a center hinge assembly, (b) a pair of foldable wing assemblies attached to the center hinge assemblies and extending transversal to the lateral center bar, (c) a pair of collapsible main leg assemblies each attached to the center hinge assemblies, and wherein the center hinge assemblies being configured to pivot the main leg assemblies to a predetermined angle from each other to define a base on a surface, and (d) a leg support assembly secured between the pair of collapsible main leg assemblies, and wherein the leg support assembly includes leg support hinges configured to permit the pair of collapsible main leg assembles to pivot away from each other at the predetermined angle.

The clothes rack of the aforementioned embodiment may define each of the foldable wing assemblies by including (a) a first wing assembly extending transversal to the lateral center bar and having sides transversally distal to each other, the first wing assembly being secured at one of the sides to the center hinge assemblies and secured at the other side to a pair of first wing hinge assemblies; (b) an outside wing assembly extending transversal to the lateral center bar and having sides transversally distal to each other, the outside wing assembly being secured at one of the sides to the pair of first wing hinge assemblies and having a U-shaped end at the other side; and (c) wherein the pair of first wing hinge assemblies are configured to pivot and maintain the outside wing assemblies in various planes angled from the first wing assemblies, including a plane substantially parallel to the first wing assemblies, a plane angled upwardly from the first wing assemblies, and a plane substantially overlapping the first wing assembles.

The clothes rack of the aforementioned embodiment may define each one from the pair of collapsible main leg assemblies by including an upper leg assembly, a bottom leg assembly, and a middle leg assembly removably attached at one end to the upper leg assembly and removably attached at the other end to the bottom leg assembly. In addition, the leg support assembly may be secured between the two middle leg assemblies defined on either one of the pair of main leg assemblies.

The clothes rack of the aforementioned embodiment may define each of the center hinge assemblies to include: (a) a central open to receive an end of the lateral center bar; (b) four hinge members, each defined to include a circular hub with an extending cylindrical tube hollowed to receive an end of a post, the four hinge members are paired to configure one pair extending transversally to connect to the pair of foldable wing assemblies and a second pair extending downwardly to connect to the collapsible main leg assemblies; and (c) wherein each of the hinge members includes an over-flange member configured adjacent to an edge of its circular hub such that when assembled the over-flange members on a paired hinge member restrict movement to prevent over twisting of the hinges.

The clothes rack of the aforementioned embodiment may define the first wing assemblies to each include: (a) a pair of outside first wing posts and a plurality of first wing lateral cross bars secured therebetween, and (b) each of the pair of outside first wing posts include a first wing interior end configured to connect to the center hinge assemblies, and further include a first wing exterior end distal to the first wing interior end and configured to connect to the pair of first wing hinge assemblies.

The clothes rack of the aforementioned embodiment may define the pair of first wing hinge assemblies to each include: (a) a front first wing hinge assembly and a rear first wing hinge assembly, (b) each of the front and rear first wing hinge assemblies include a pair of first hinge members, each first hinge member has a circular hub with an extending cylindrical tube hollowed to receive an end of a post, the cylindrical tube further includes a lateral opening, (c) a pair of lateral first wing hinge support bars secured in the lateral openings and extending between the front and rear first wing hinge assemblies, and (d) wherein each of the first hinge members further includes an over-flange member configured when assembled to prevent over twisting of the hinges, and wherein each of the circular hubs in the front and rear first wing hinge assemblies are configured to include radial ribs to divide the circular hub into sections, and where one of the sections includes at least two arcuate cross ribs positioned between two of the radial ribs.

The clothes rack of the aforementioned embodiment may define each of the outside wing assemblies include: (a) an outside U-shaped support bar having a pair of outside wing post legs and outside wing post end configured to secure to the first wing hinge assemblies; and (b) a plurality of outside wing lateral cross bars secured between the post legs.

The clothes rack of the aforementioned embodiment may define the upper leg assembly to include a pair of upper leg posts with at least one lateral upper leg bar secured between the pair of upper leg posts, and wherein each of the upper leg posts includes an upper leg first end configured to secure to the center hinge assembly and further includes an upper leg second end, and wherein the upper leg second end tapers to a smaller cylindrical profile such that the upper leg second end secures into a defined middle leg first end on the middle leg assembly.

The clothes rack of the aforementioned embodiment may define the middle leg assembly to include a pair of middle leg posts with at least one lateral middle leg bar secured between the pair of middle leg posts, and wherein each of the middle leg posts includes the middle leg first end, and a middle leg second end, wherein the middle leg second end tapers to a smaller cylindrical profile such that the middle leg second end secures into a defined lower leg first end on the lower leg assembly.

The clothes rack of the aforementioned embodiment may define the lower leg assembly to include a U-shaped base member with a pair of lower leg posts and at least two lateral lower leg bars secured between the pair of lower leg posts, and wherein each of the lower leg posts includes the lower leg first end.

The clothes rack of the aforementioned embodiment may define the leg support assembly to include a pair of leg support hinges with a circular hub hinge and an extending arm, the extending arm includes an arm end with an opening sized to receive the lateral middle leg bar, and wherein the circular hub hinge includes an over-flange member positioned adjacent to the circular hub hinge to restrict over twisting of the hinge.

The clothes rack of the aforementioned embodiment may further include a wing support on either side of the clothes rack, the wing supports are U shaped supports and configured to connect to the middle leg assemblies and extend upwardly to support the pair of foldable wing assemblies.

The clothes rack of the aforementioned embodiment may further include four separate wheel holders secured about a lower end of the leg support assembly; and each wheel holder configured to receive a caster wheel.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
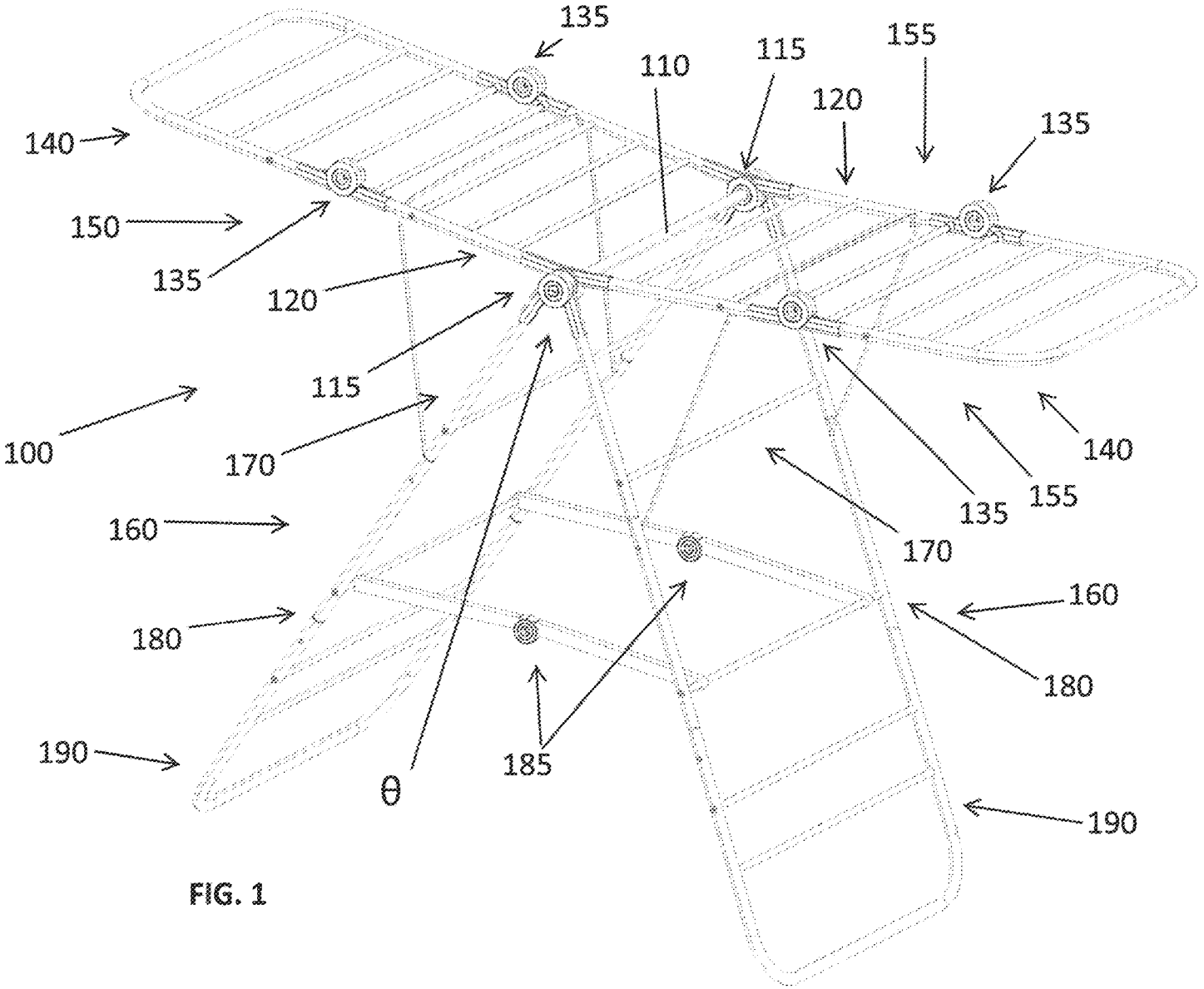
FIG. 1 is a perspective view of a collapsible clothes rack in accordance with one embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the claims by the embodiments illustrated.

Figure 2:
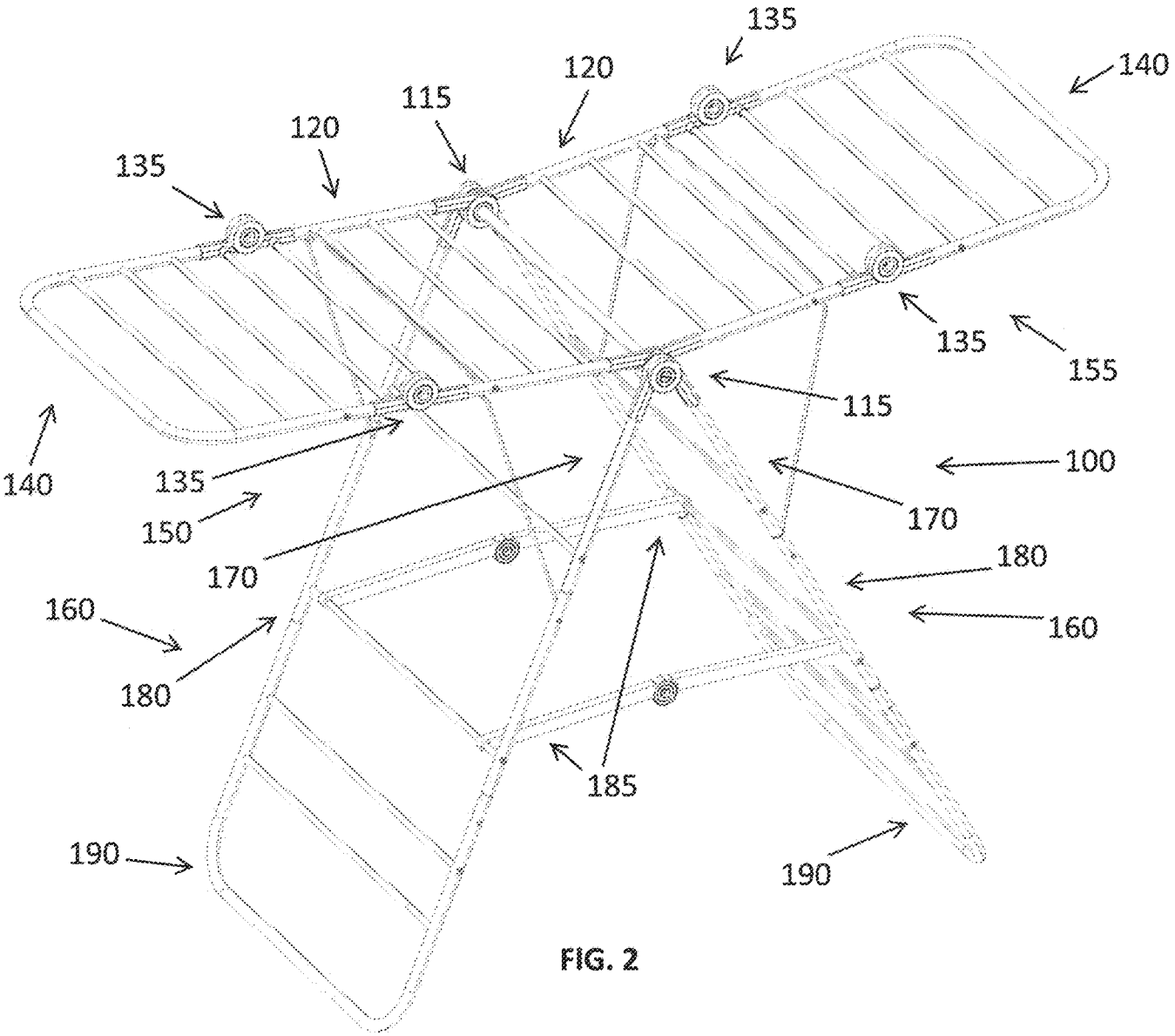
FIG. 2 is a perspective view of a collapsible clothes rack in accordance with one embodiment of the present invention.
Figure 3:
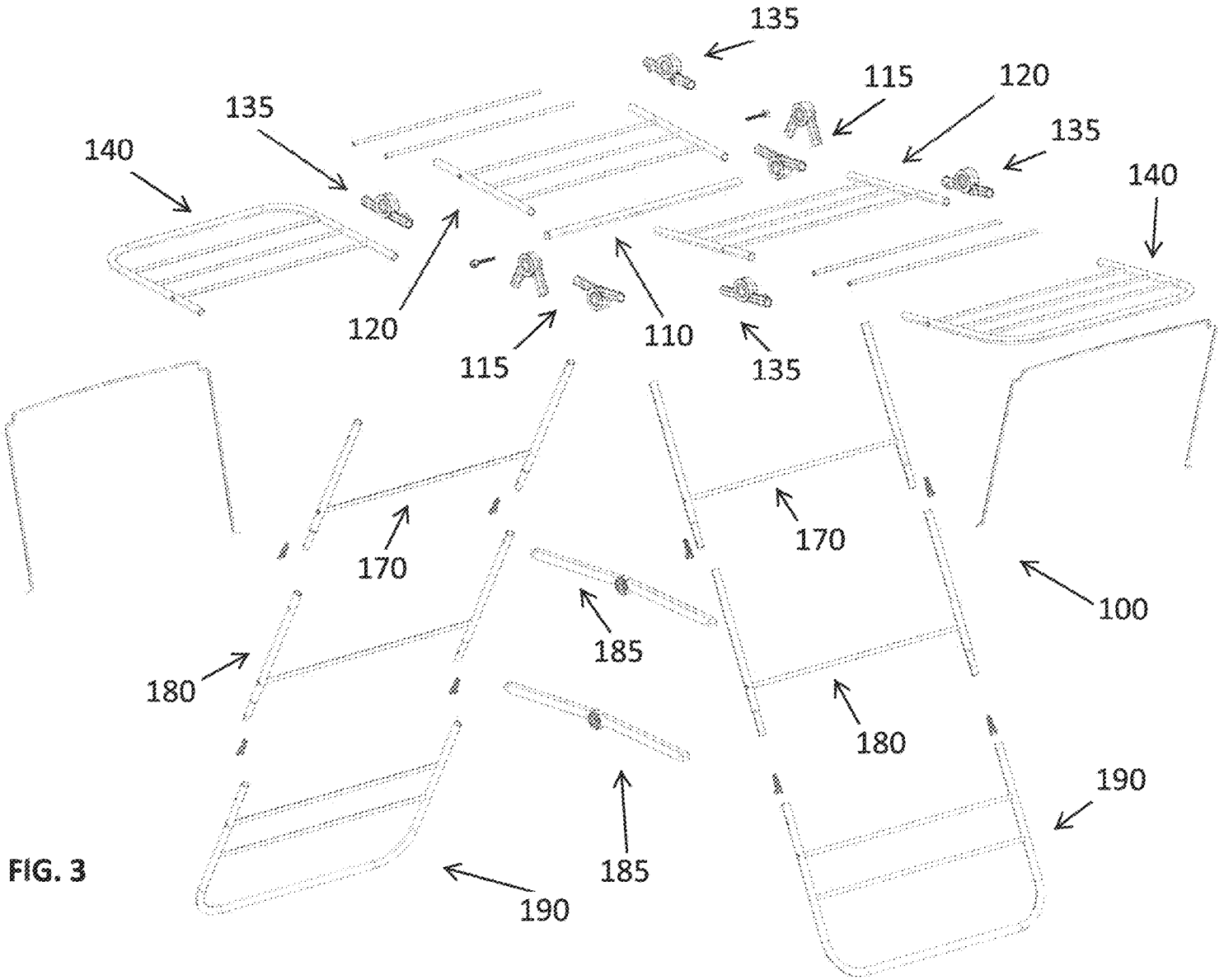
FIG. 3 is a partial exploded view of the collapsible clothes rack from FIG. 1.
Figure 4:
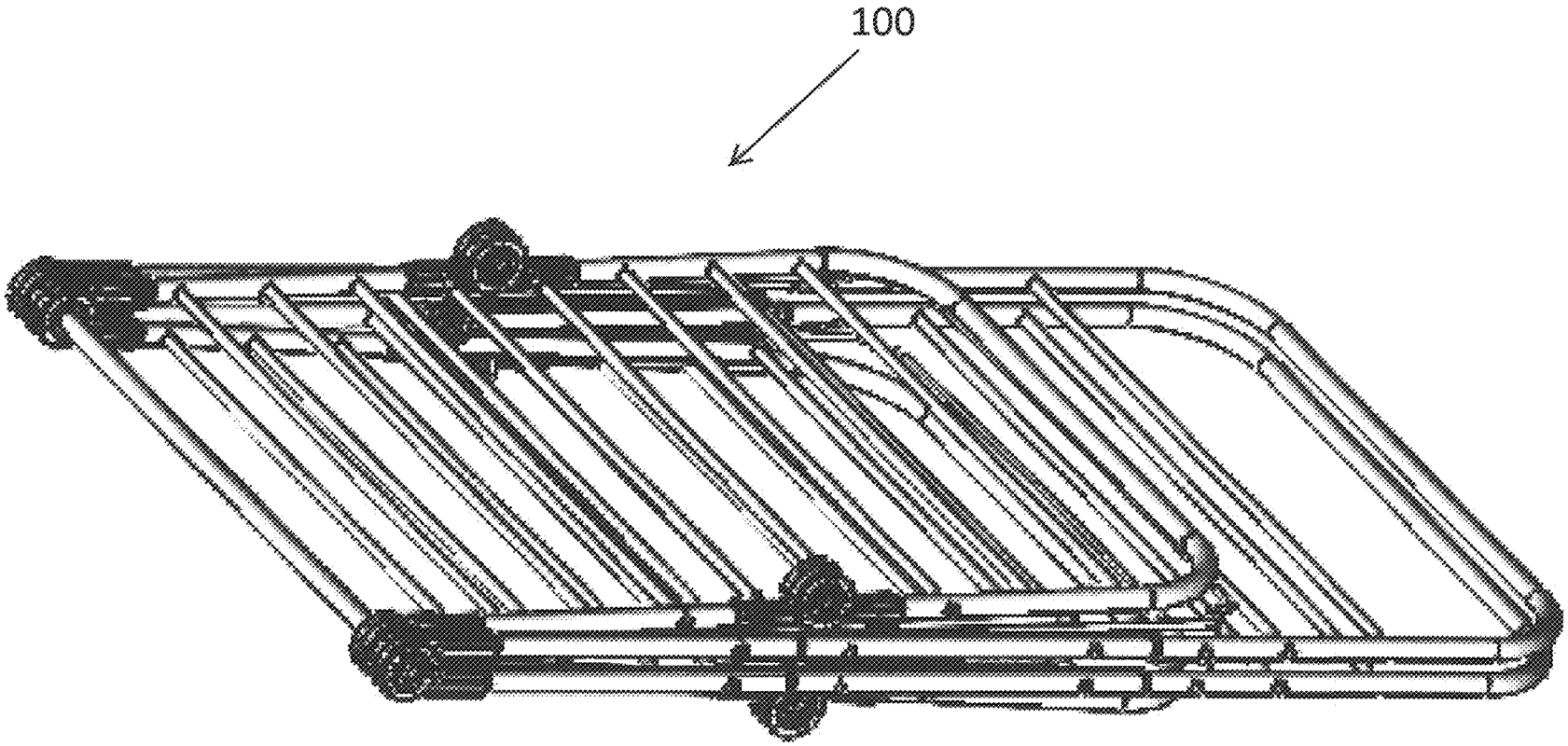
FIG. 4 is an illustration of the collapsible clothes rack in the collapsed configuration.
Figure 5:
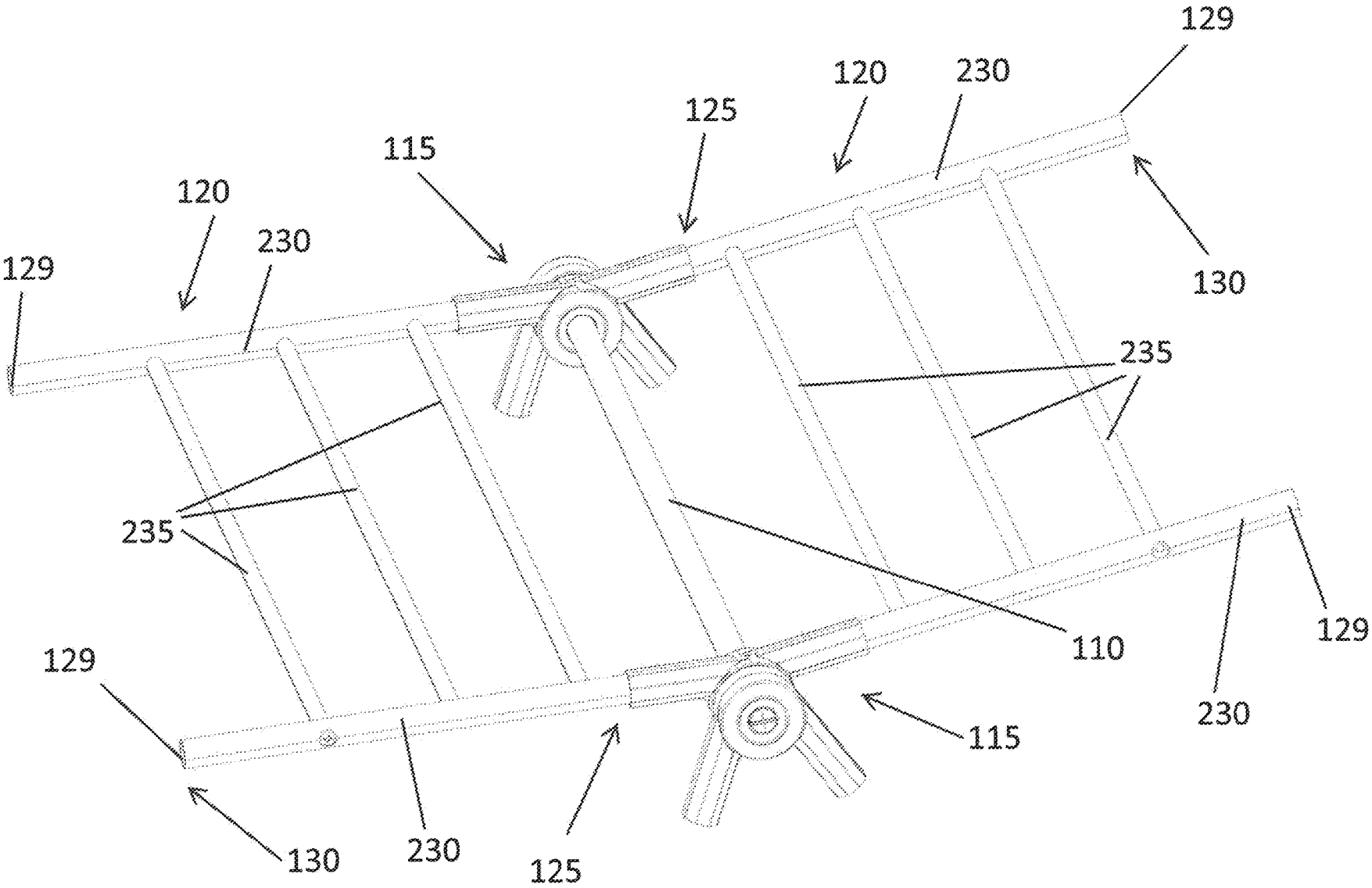
FIG. 5 is a perspective view of the first wing assemblies connected to the center hinge assemblies.
Figure 6:
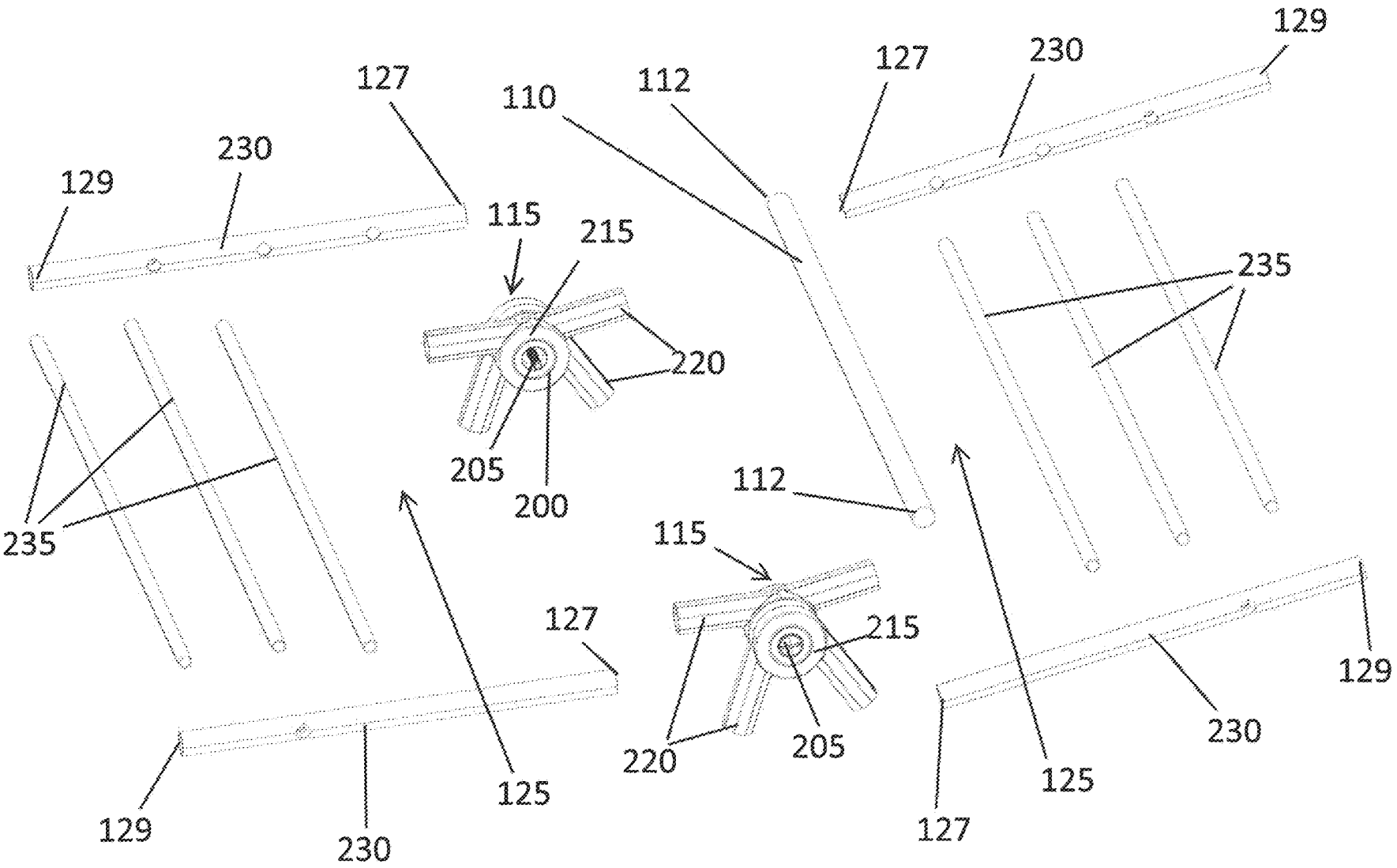
FIG. 6 is an exploded view of FIG. 5.
Figure 7:
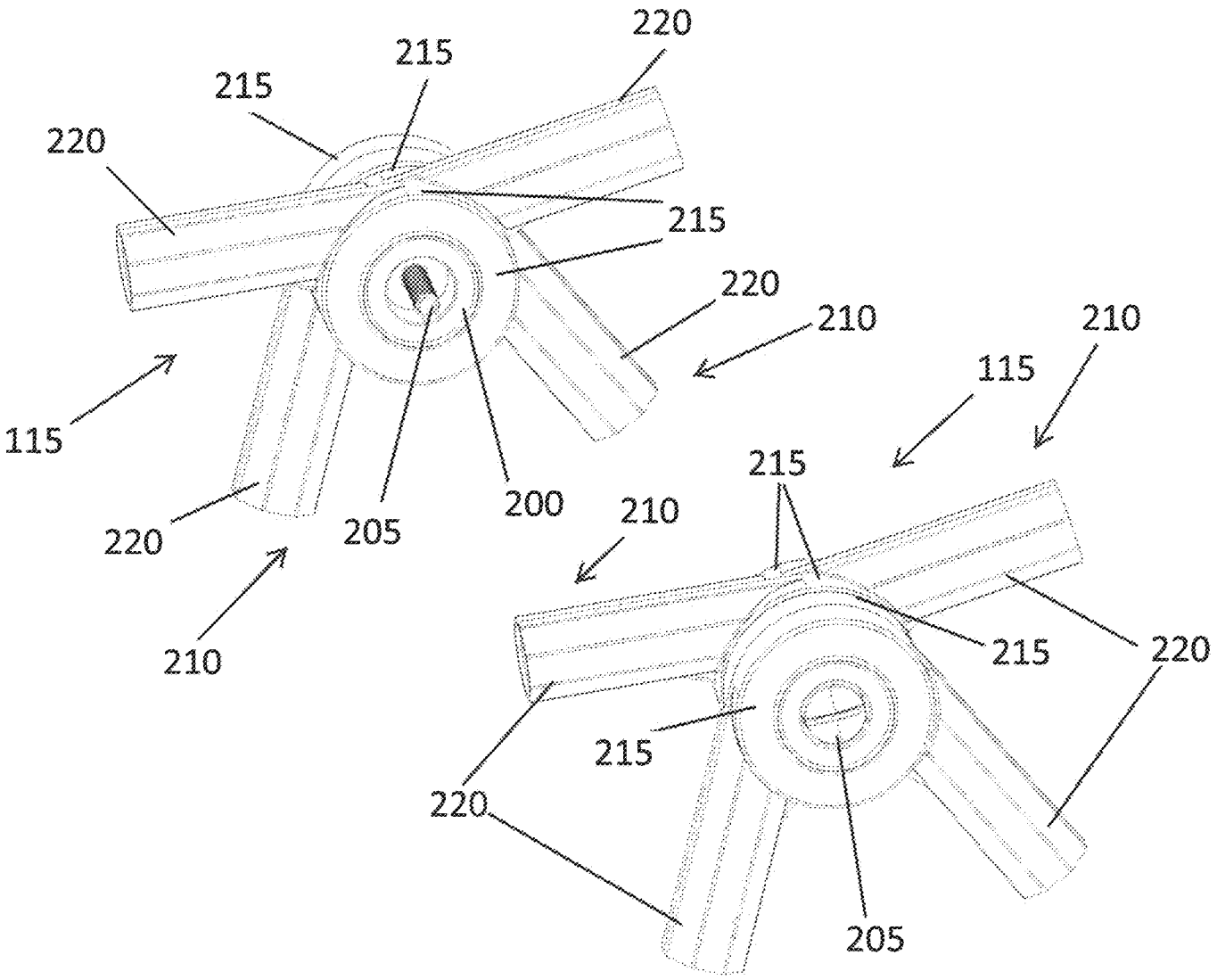
FIG. 7 is an enlarged view of the center hinge assemblies.
Figure 8:
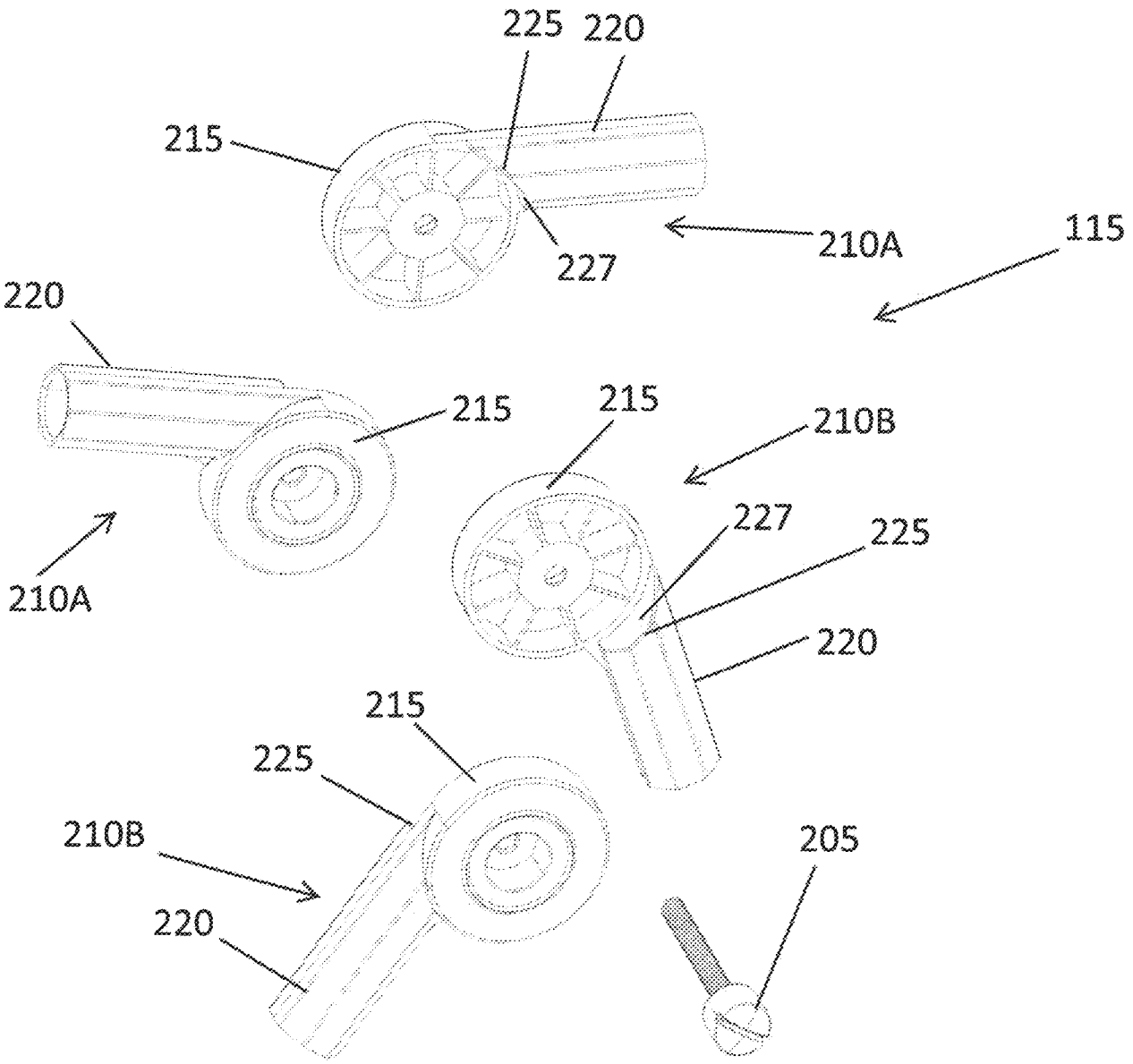
FIG. 8 is an exploded view of a center hinge assembly.
Figure 9:
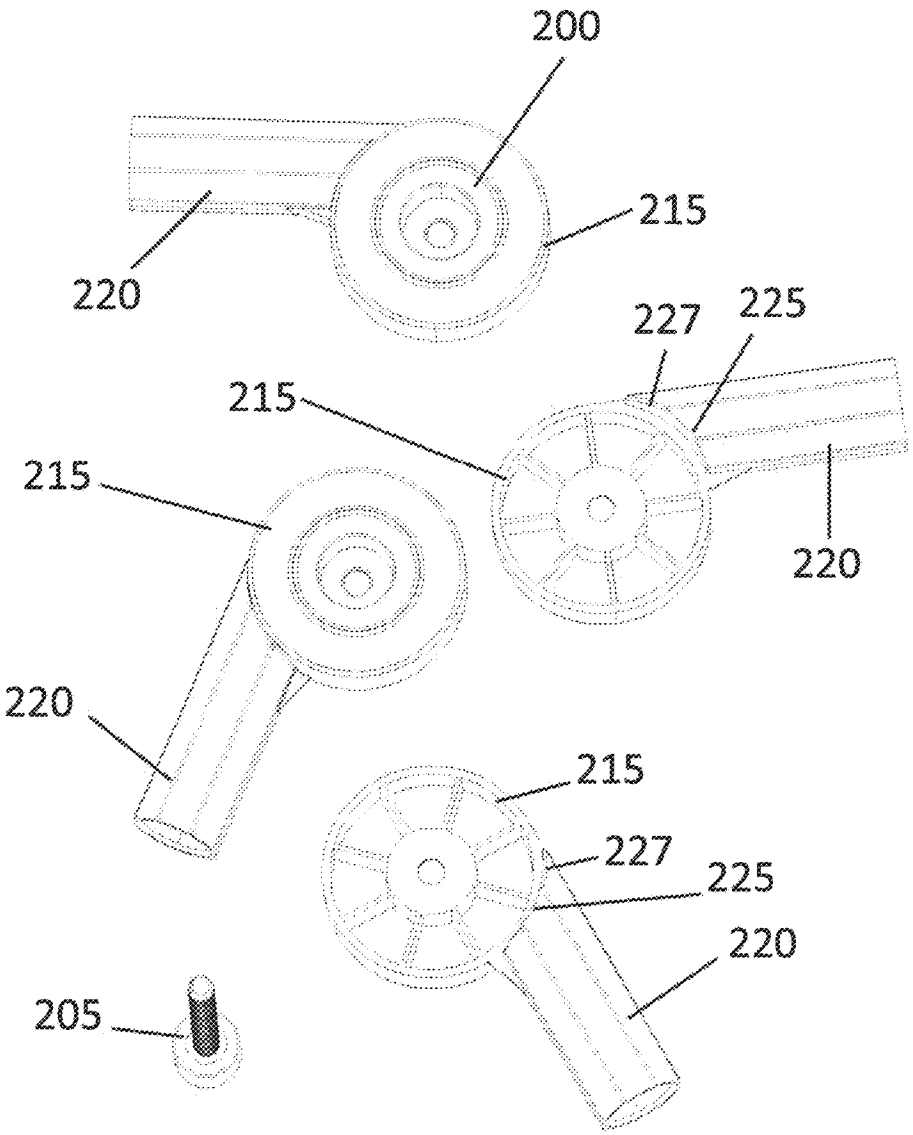
FIG. 9 is a rear exploded view of a center hinge assembly.
Figure 10:
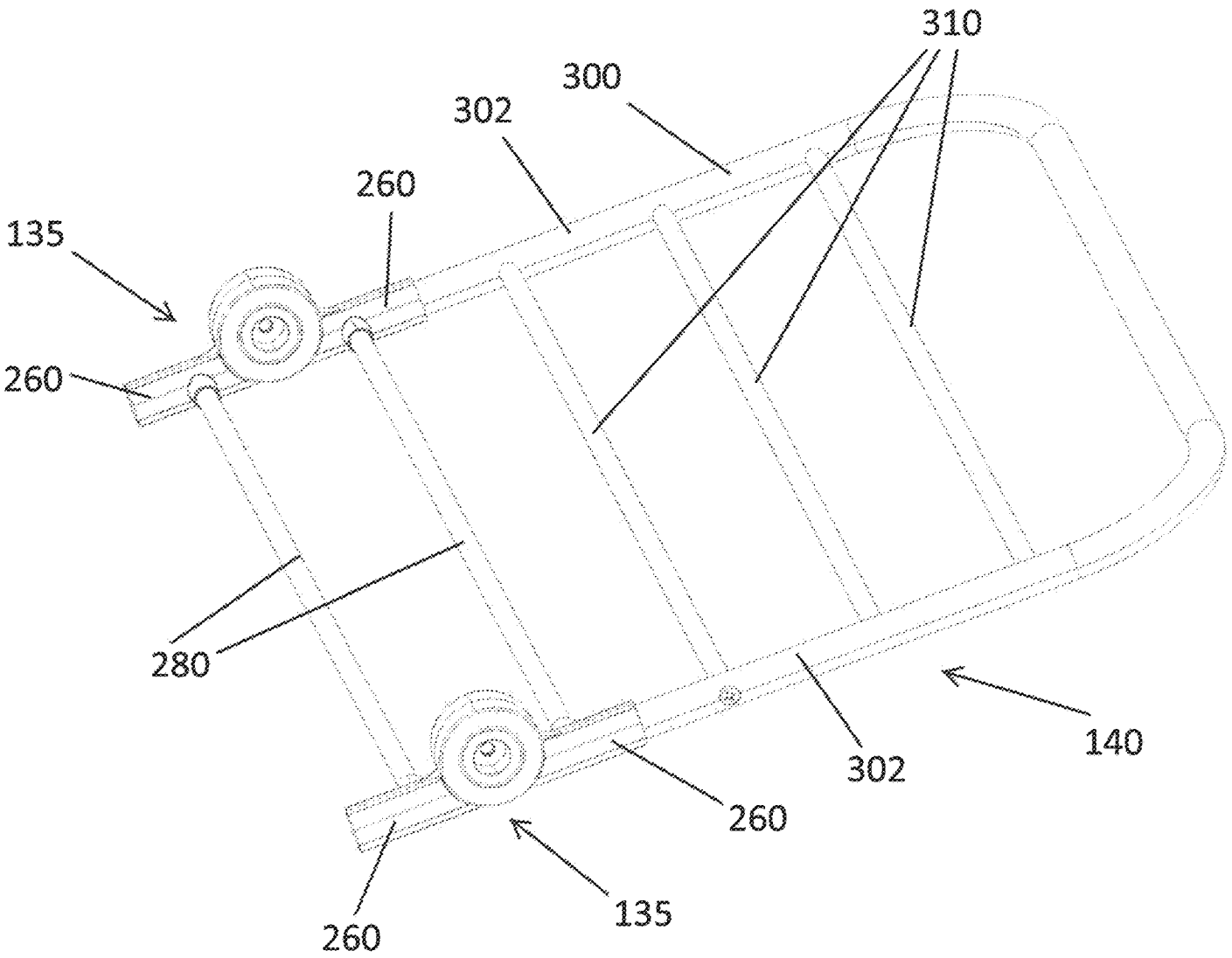
FIG. 10 is a perspective view of the outside wing assembly connected to the first wing hinge assemblies.
Figure 11:
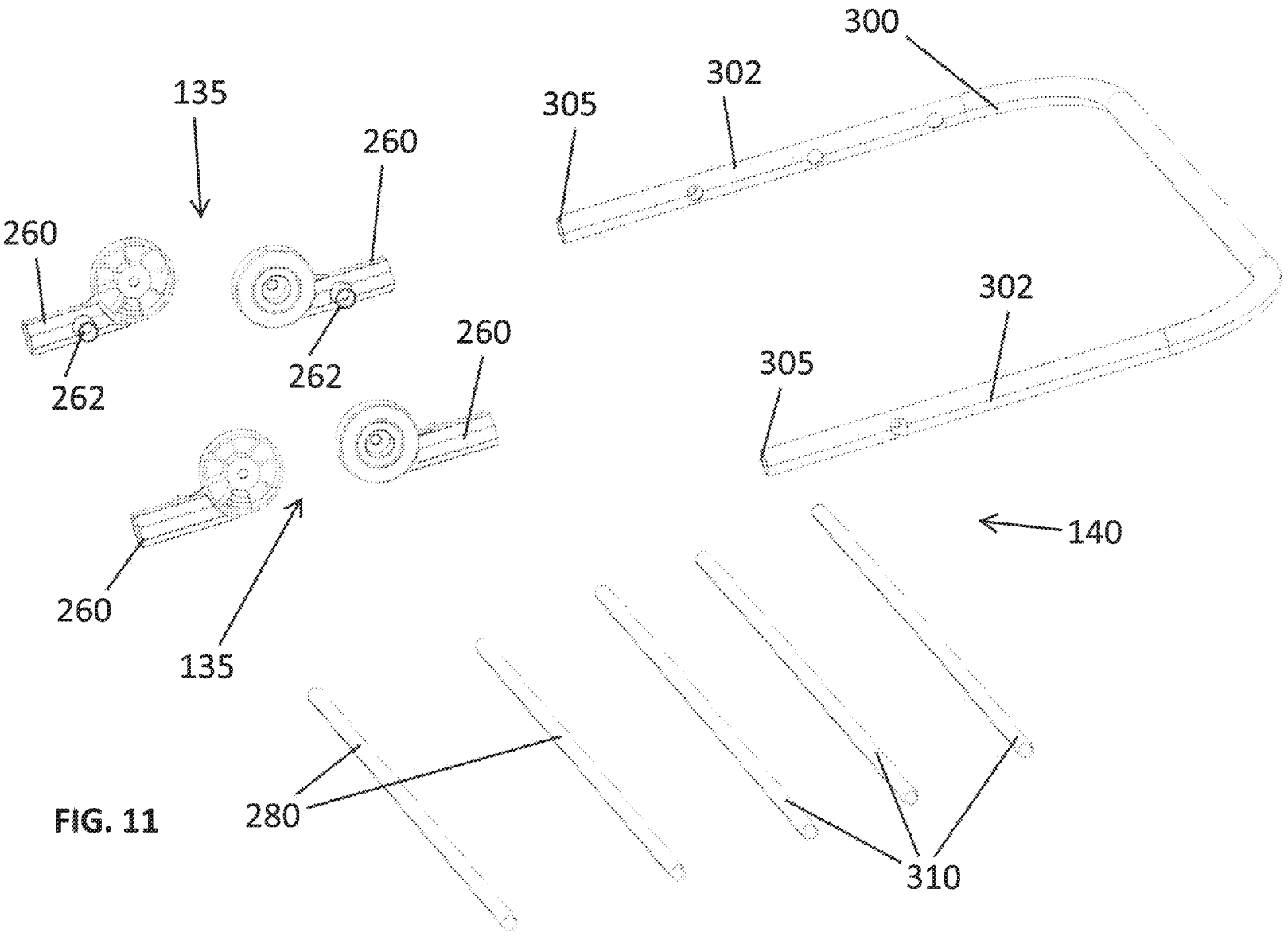
FIG. 11 is an exploded view of FIG. 10.
Figure 12:
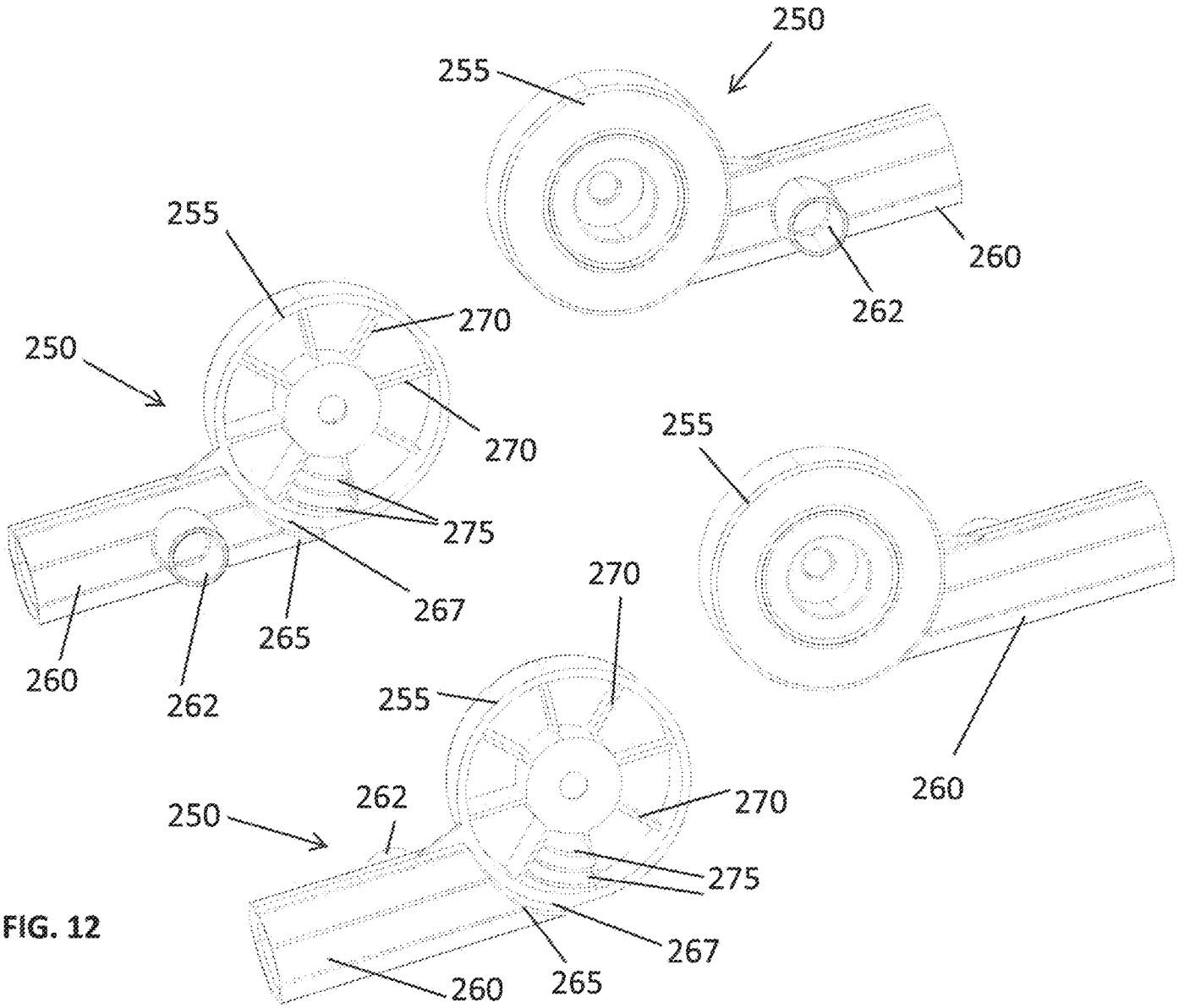
FIG. 12 is an exploded view of the first wing hinge assemblies.
Figure 13:
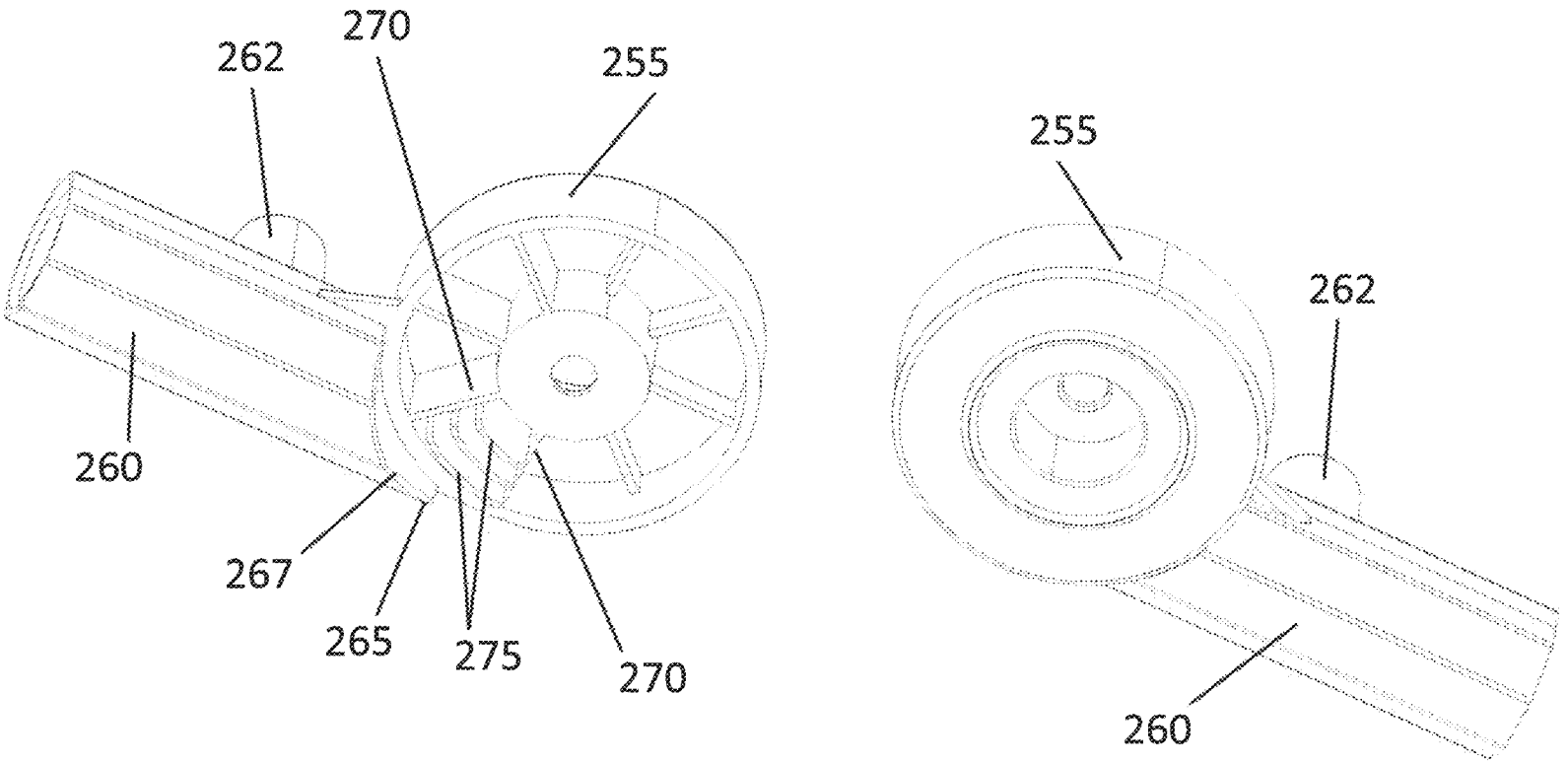
FIG. 13 is another exploded view of the first wing hinge assemblies.
Figure 14:
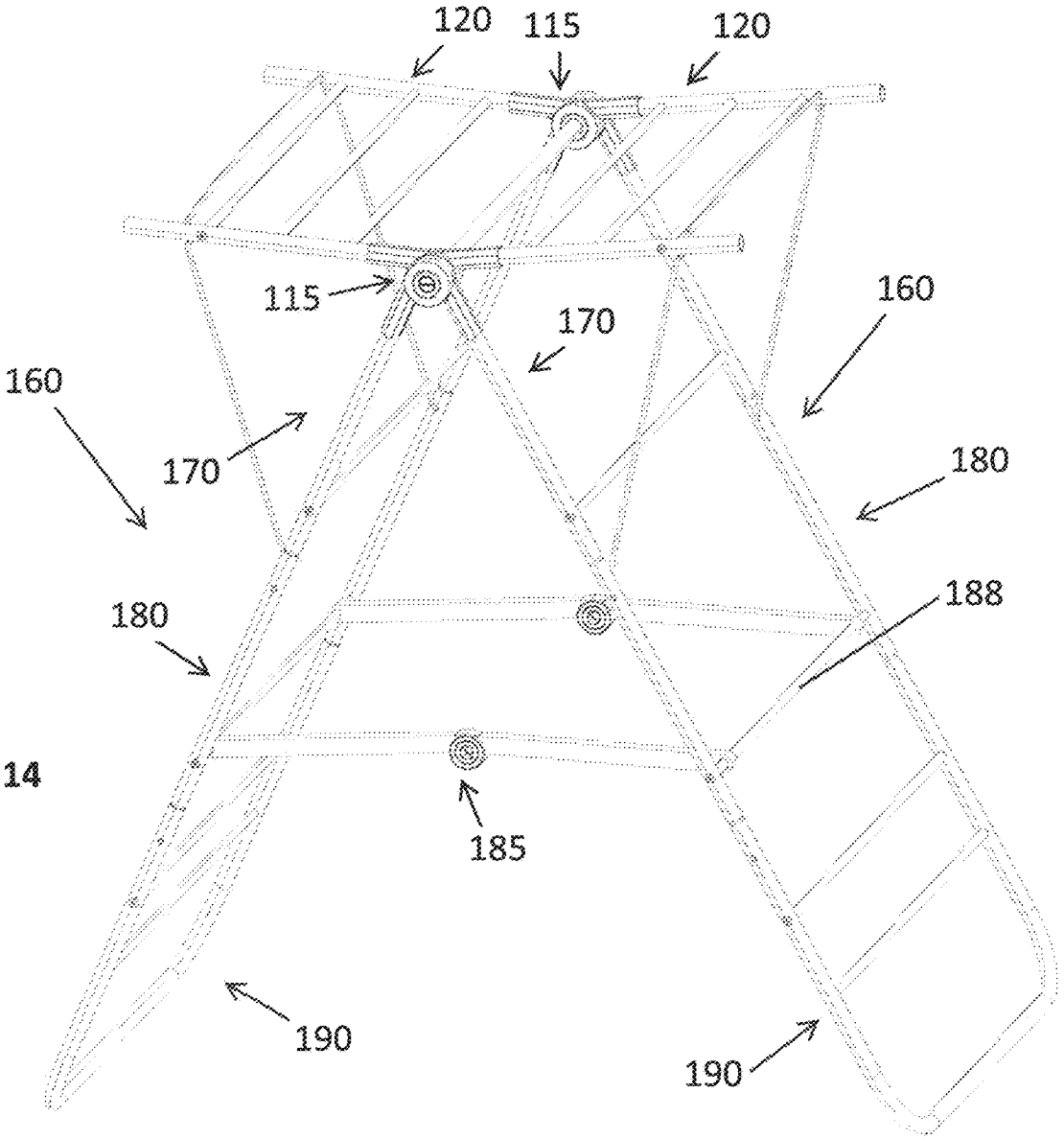
FIG. 14 is a perspective view of the leg assemblies connected to the first wing assemblies.
Figure 15:
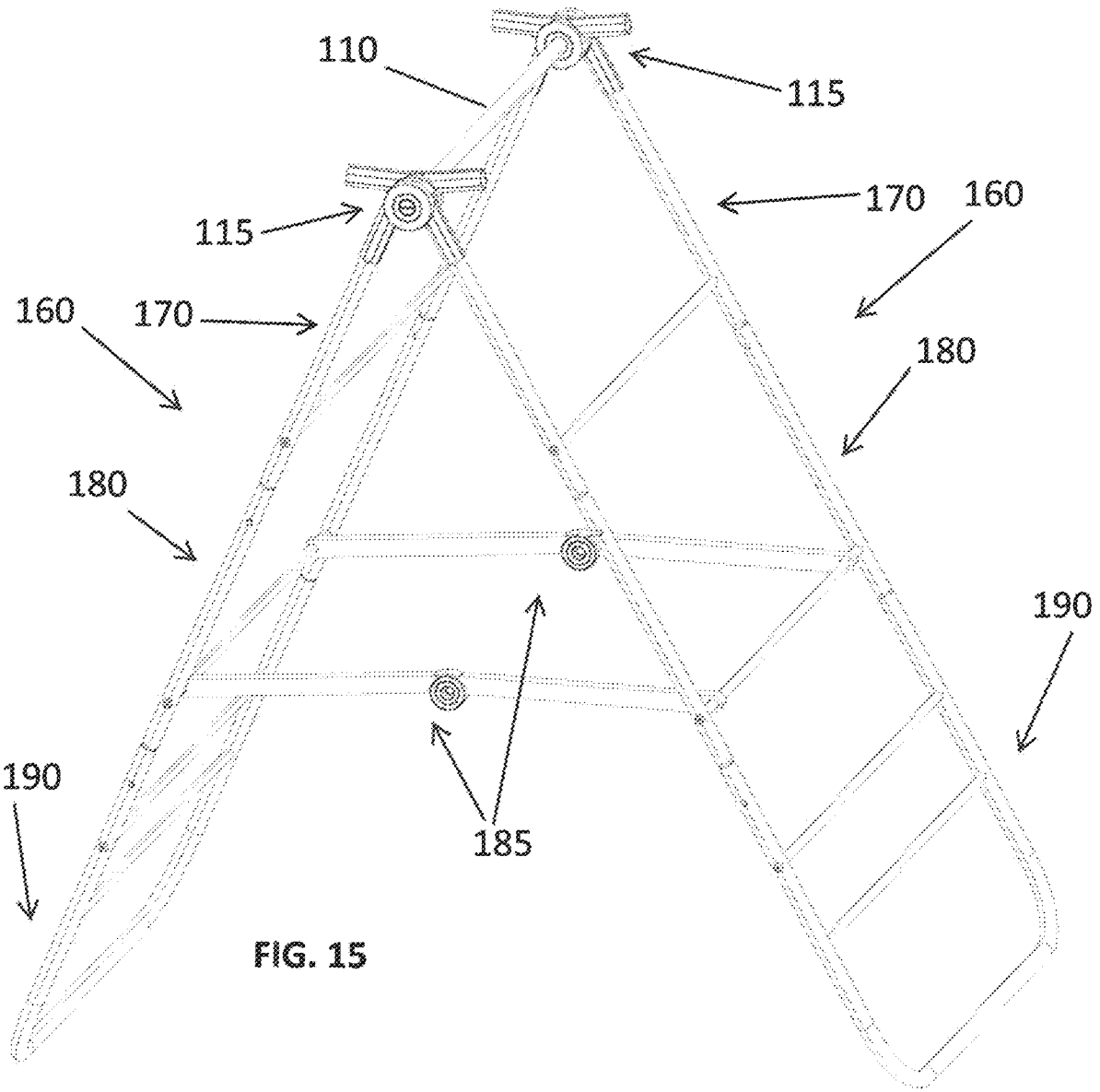
FIG. 15 is a perspective view of the leg assemblies connected to the center hinge assemblies.
Figure 16:
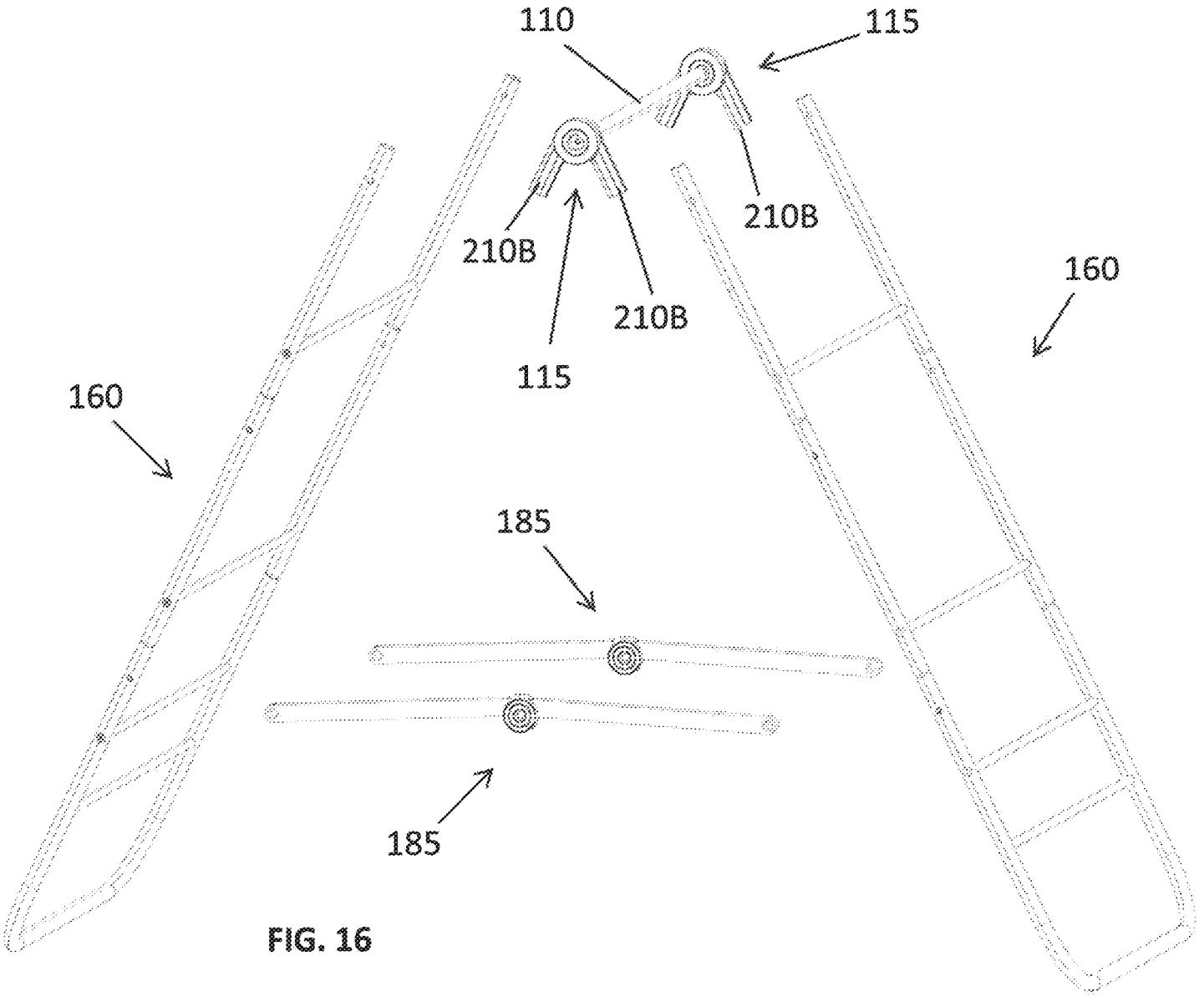
FIG. 16 is a partial exploded view of FIG. 15.
Figure 17:
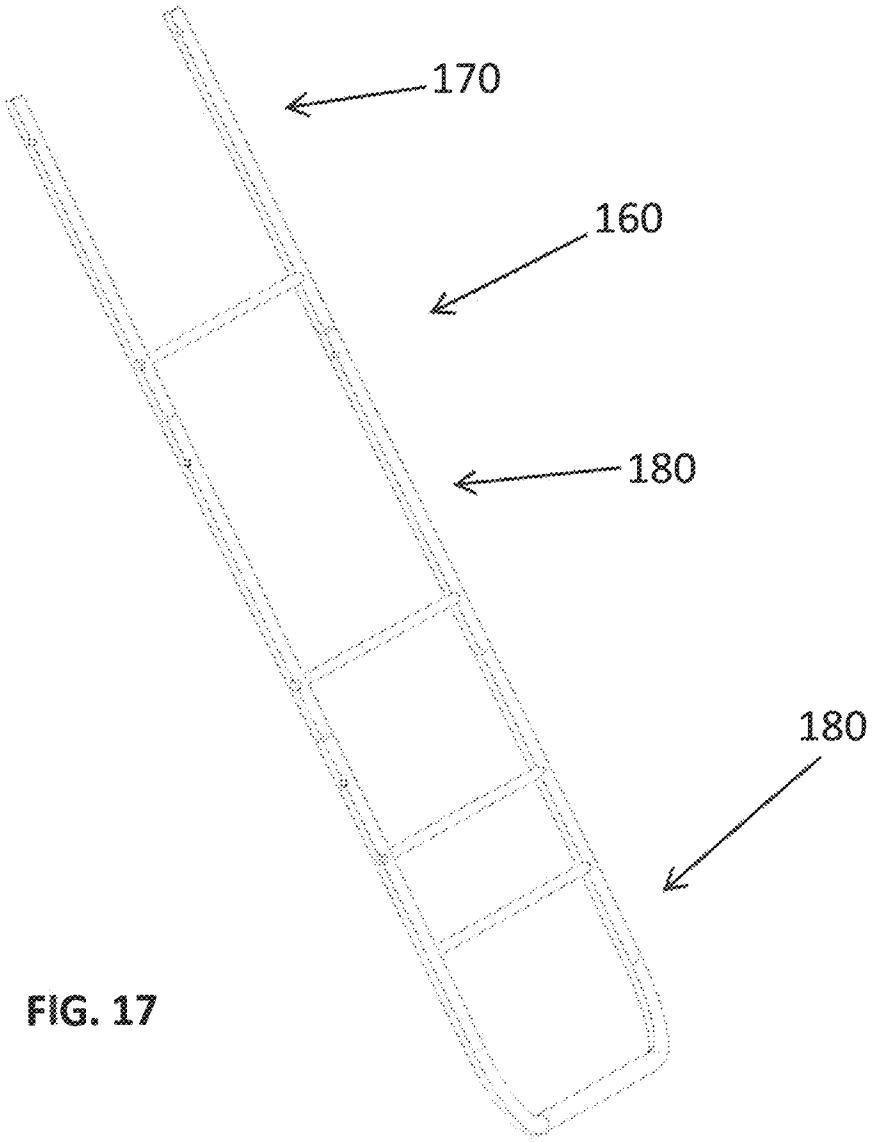
FIG. 17 is a perspective view of a leg assembly in accordance with an embodiment of the invention.
Figure 18:
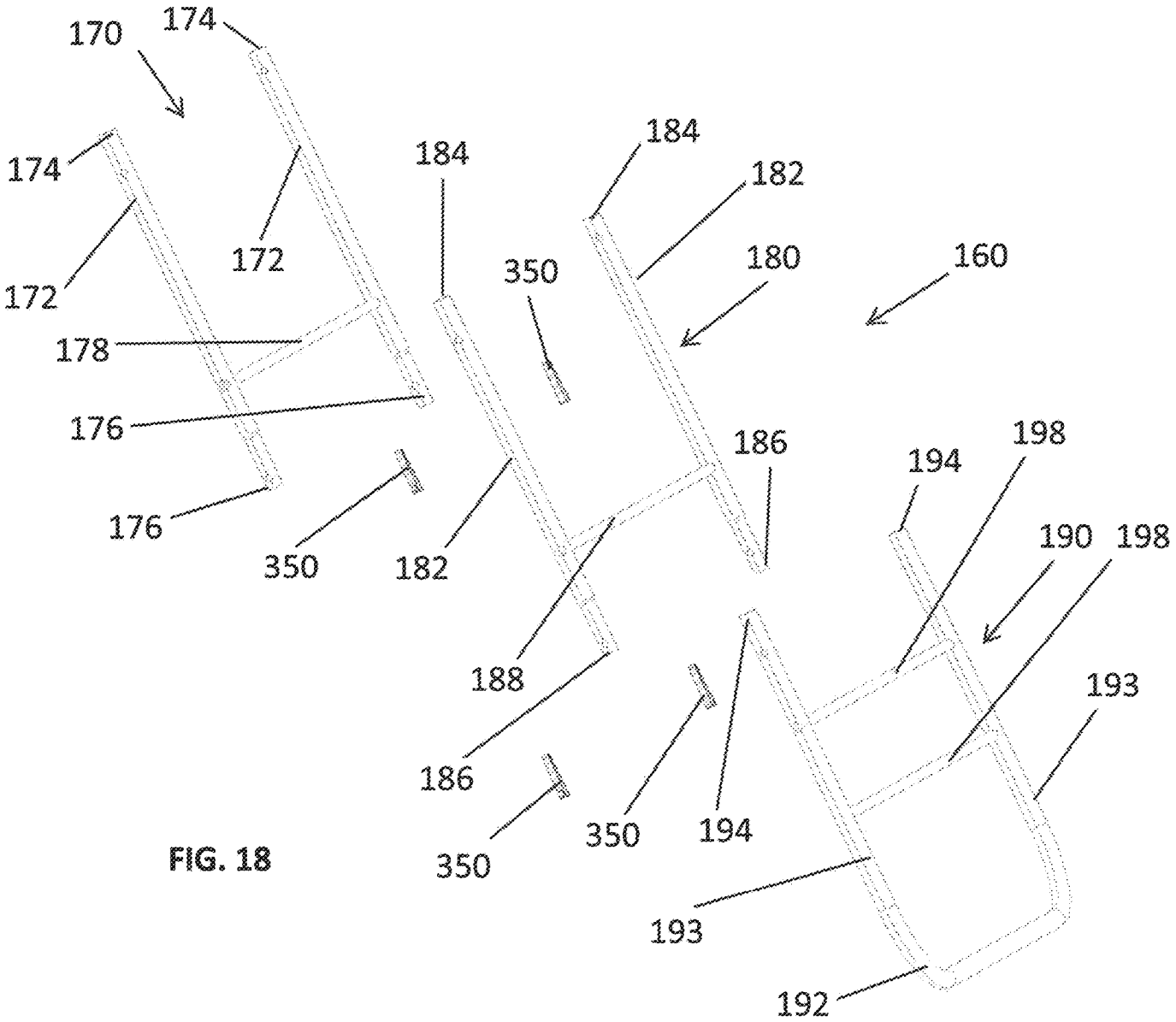
FIG. 18 is a partial exploded view of FIG. 17.
Figure 19:
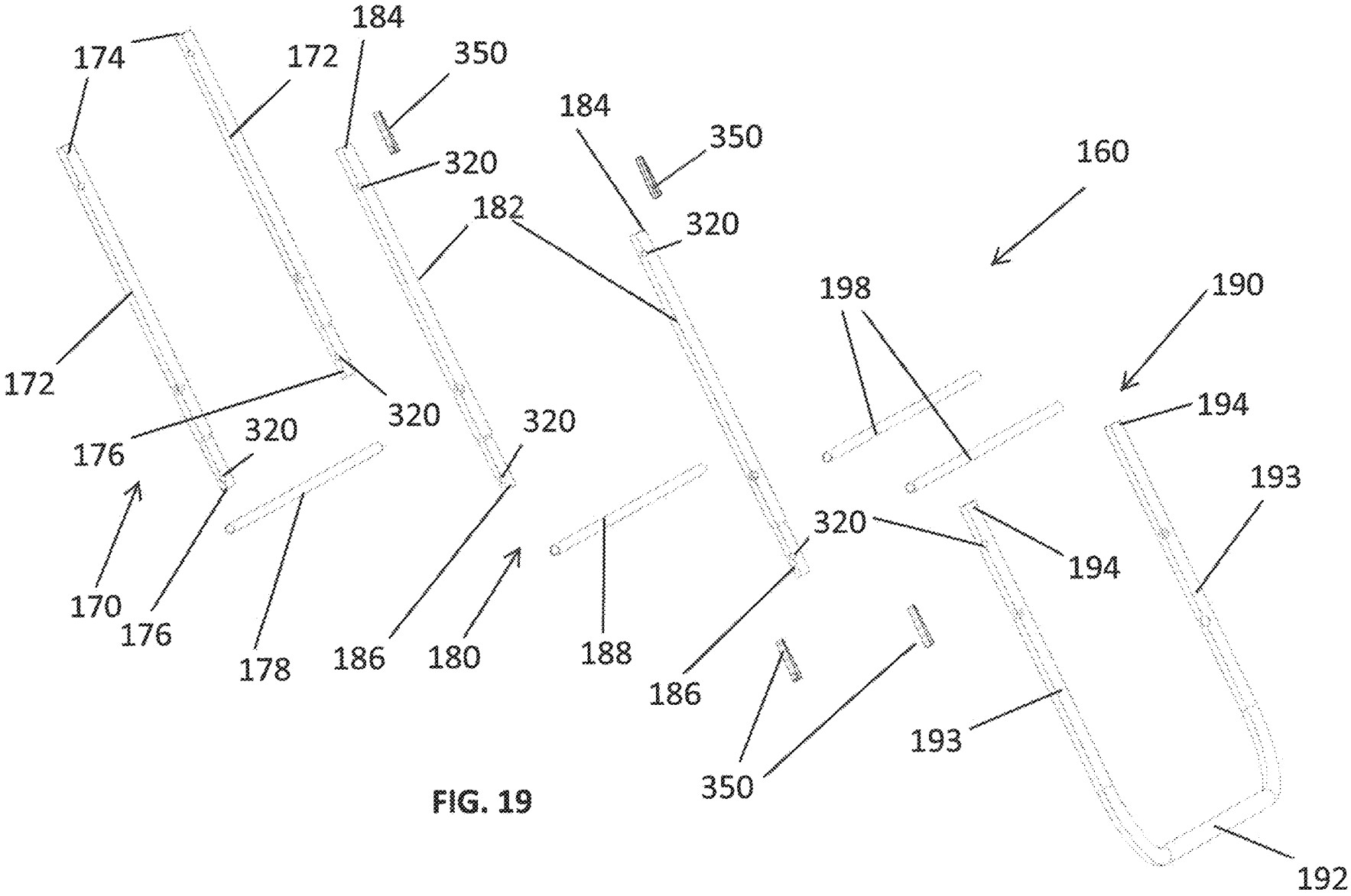
FIG. 19 is an exploded view of FIG. 17.
Figure 20:
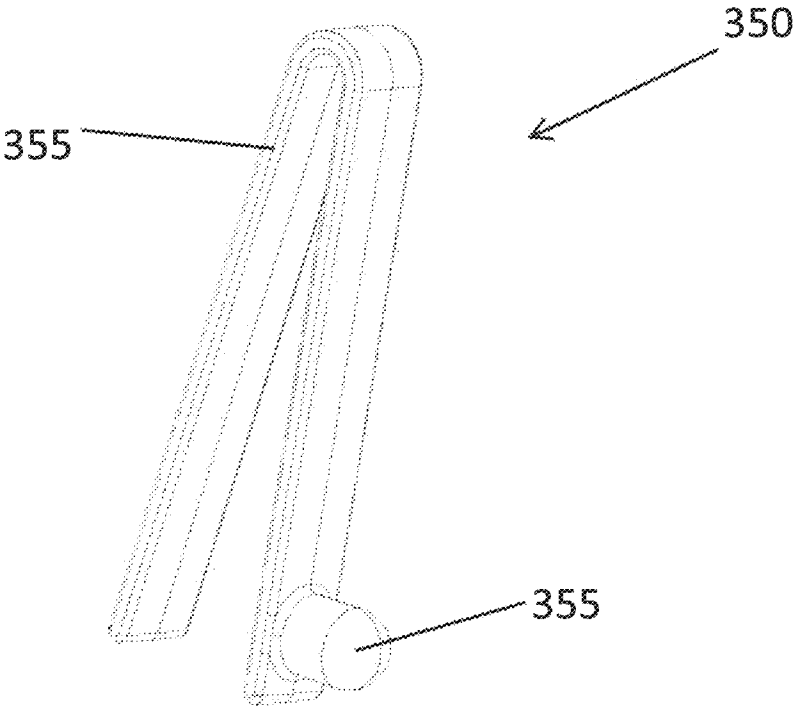
FIG. 20 is a perspective view of the push pin.
Figure 21:
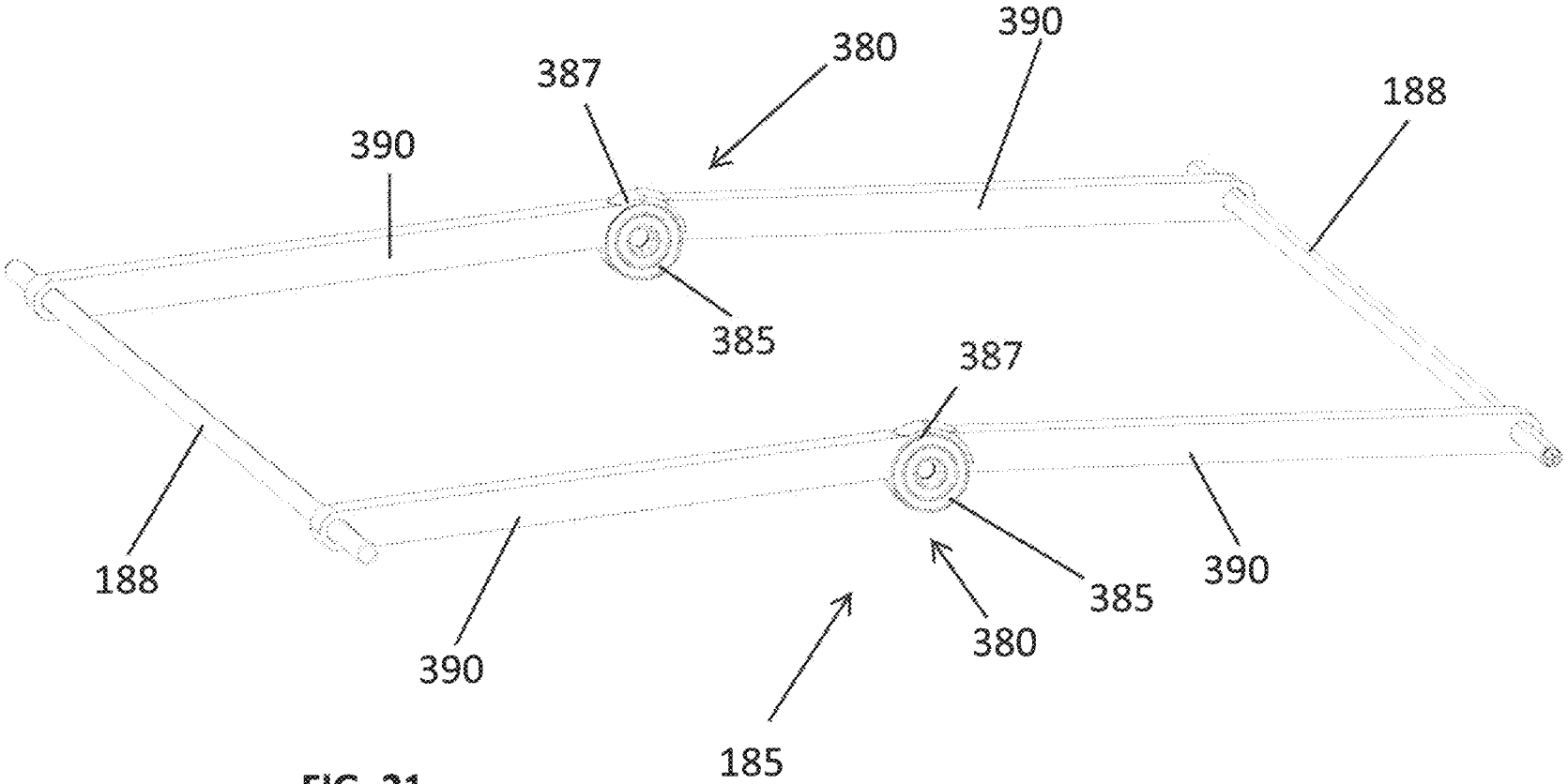
FIG. 21 is a perspective view of leg support assembly.
Figure 22:
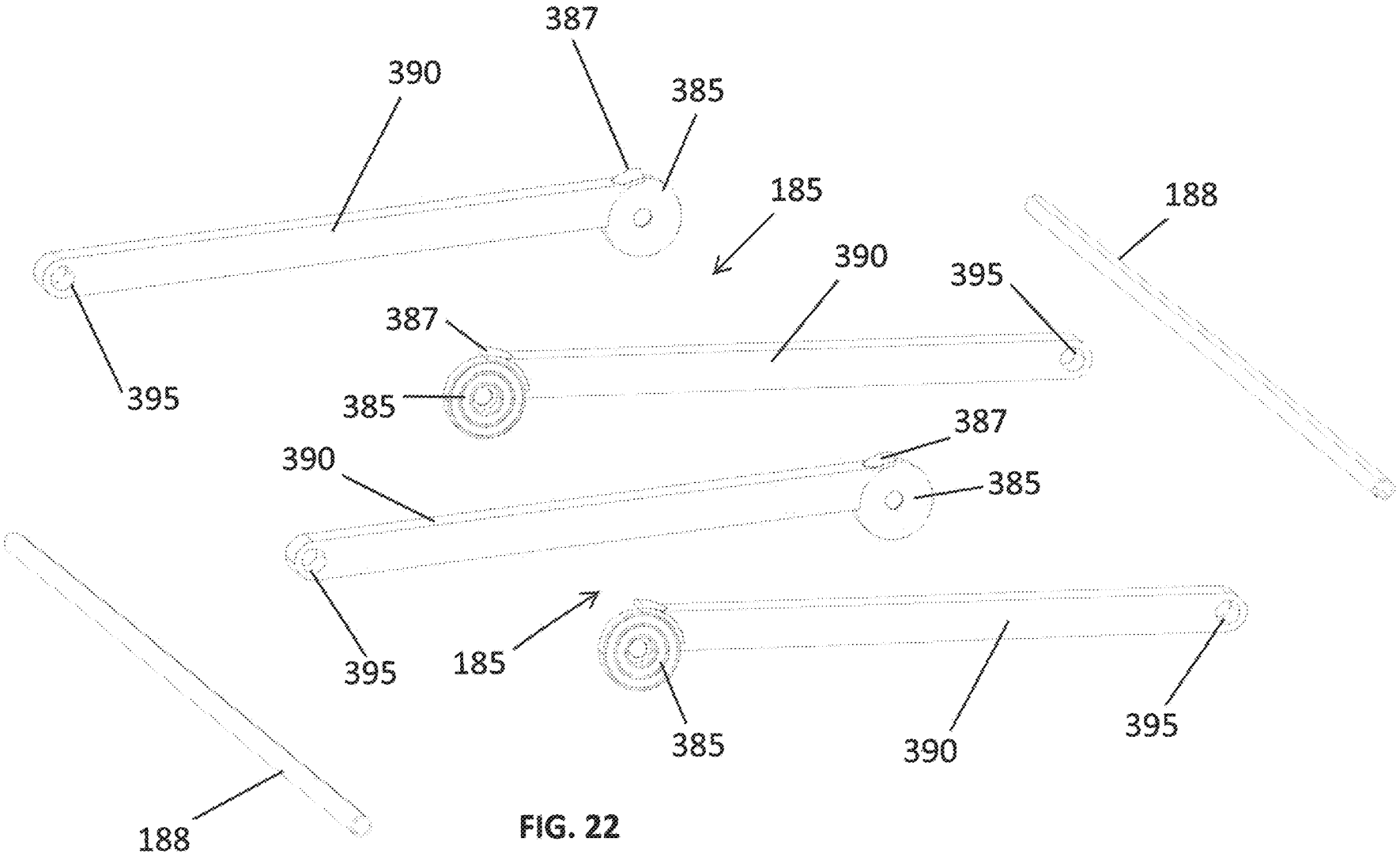
FIG. 22 is an exploded view of FIG. 21.
Figure 23:
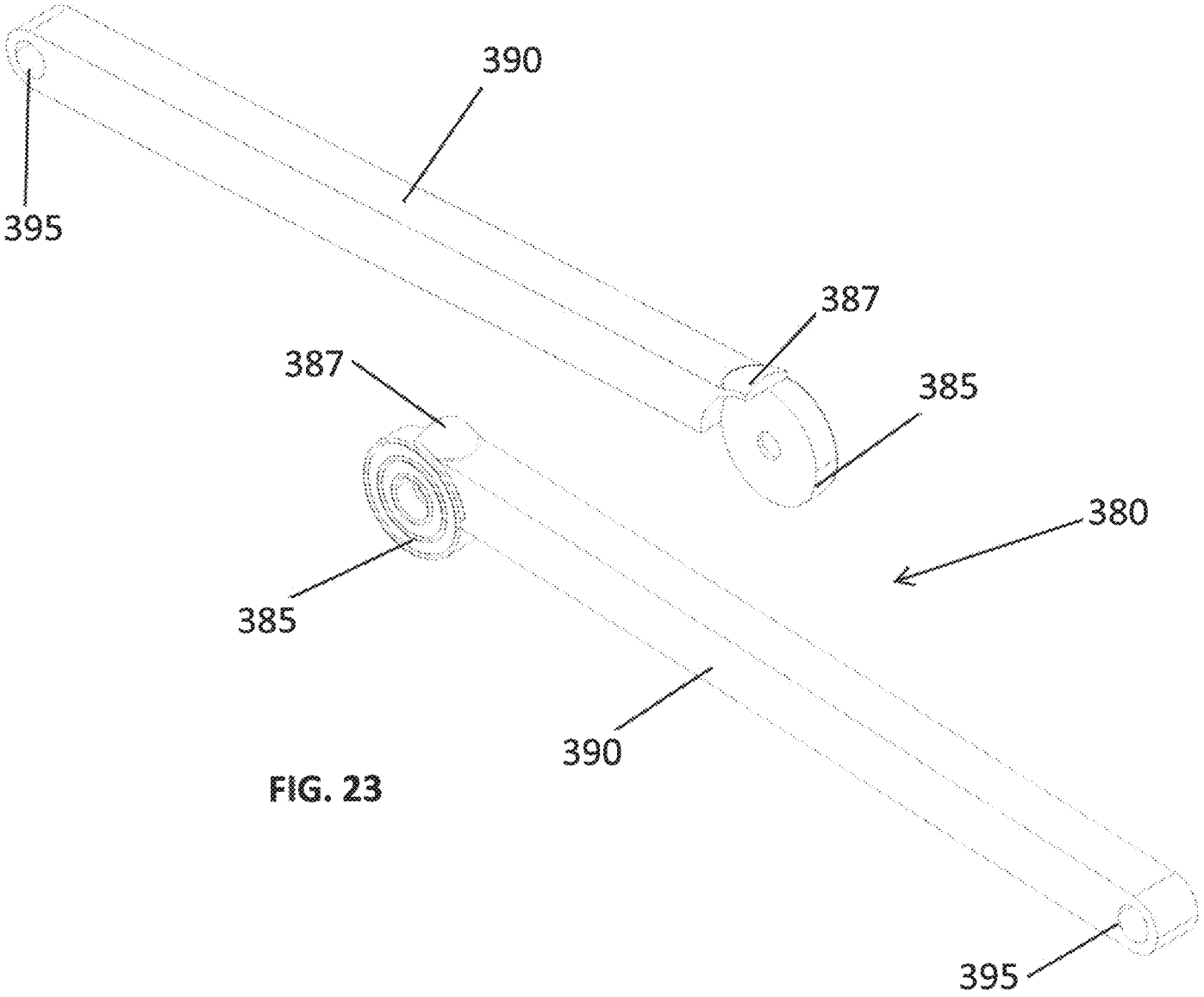
FIG. 23 is an exploded view of a leg support hinge.
Figure 24:
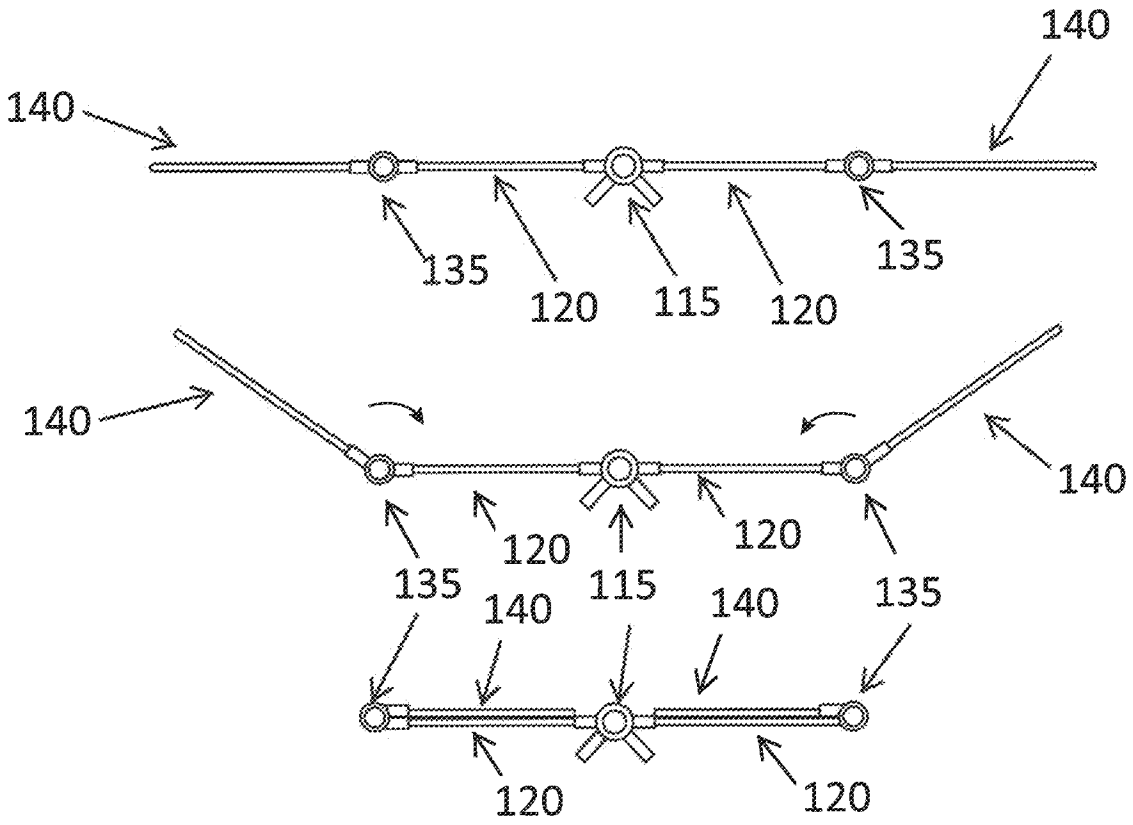
FIG. 24 is a front view of the folding aspects of the outside wing assemblies onto the first wing assemblies about the first wing hinge assemblies.
Figure 25:
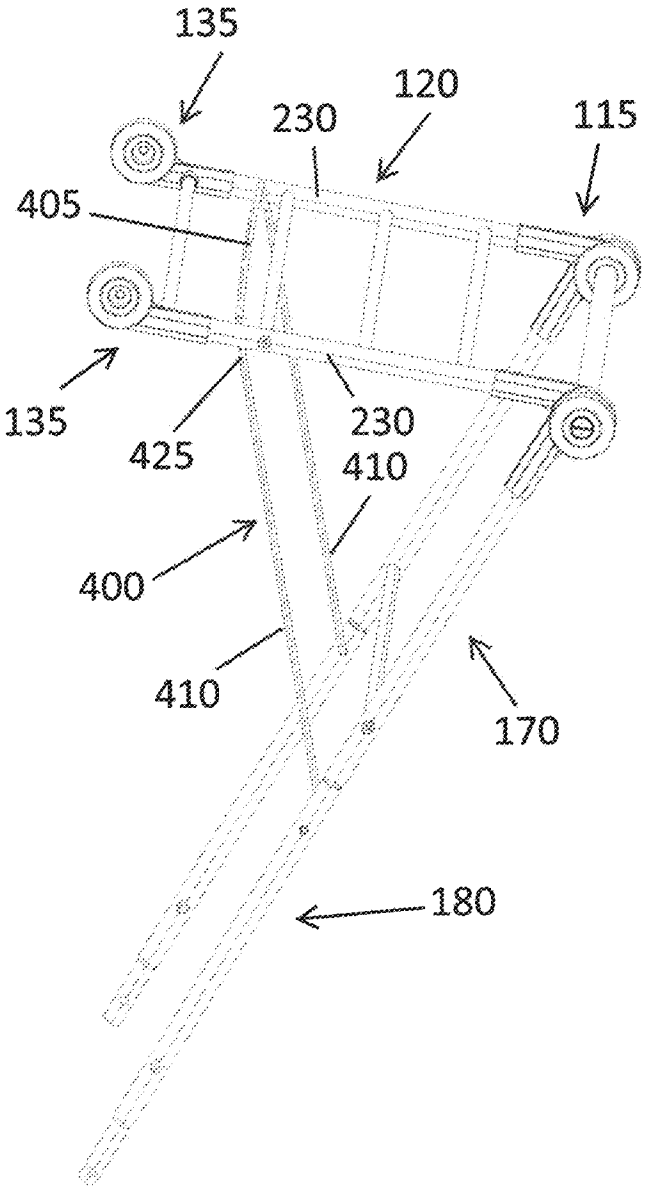
FIG. 25 is a partial sectional view illustrating a wing support.
Figure 26:
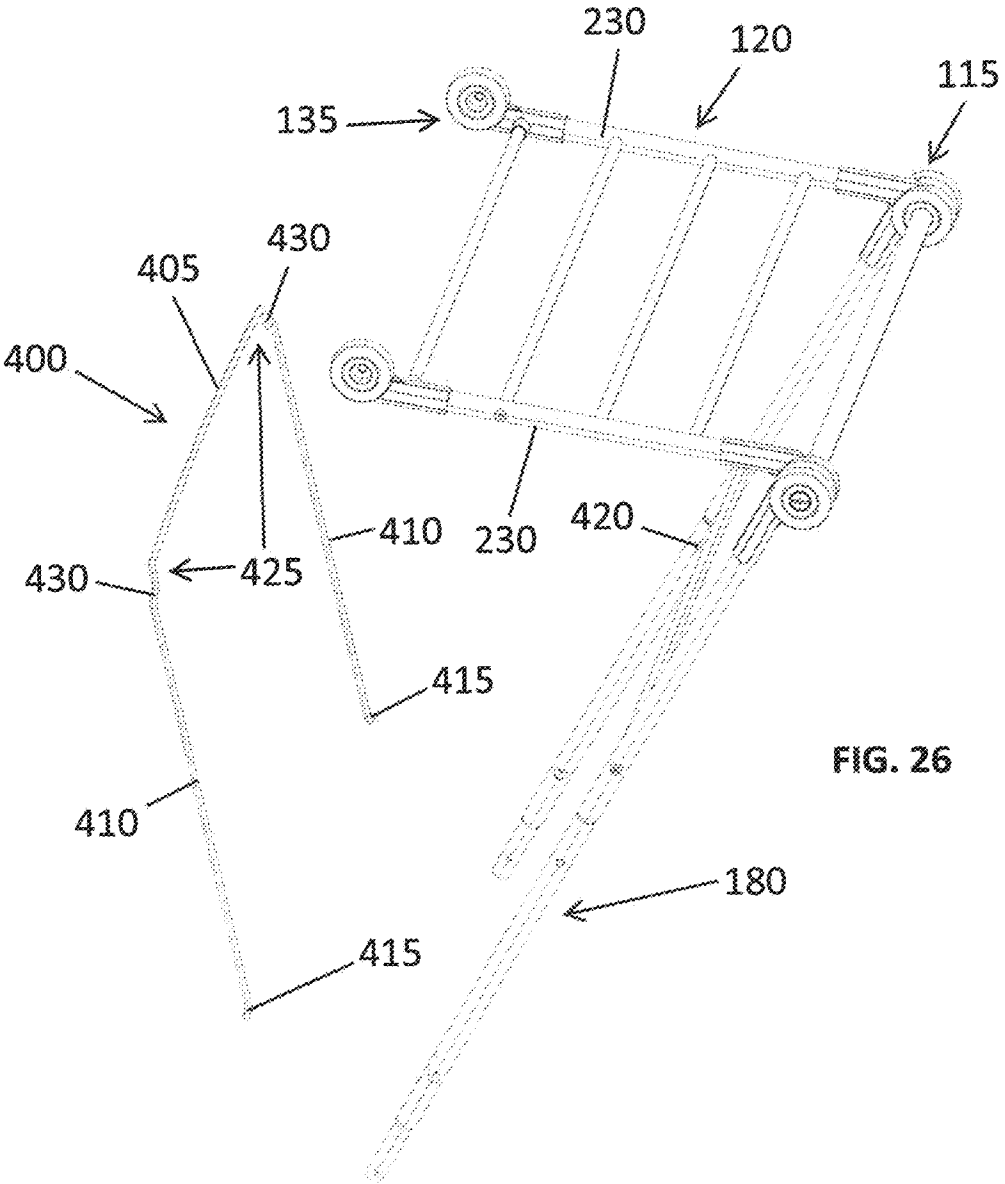
FIG. 26 is a partial exploded view illustrating the wing support.
Figure 27:
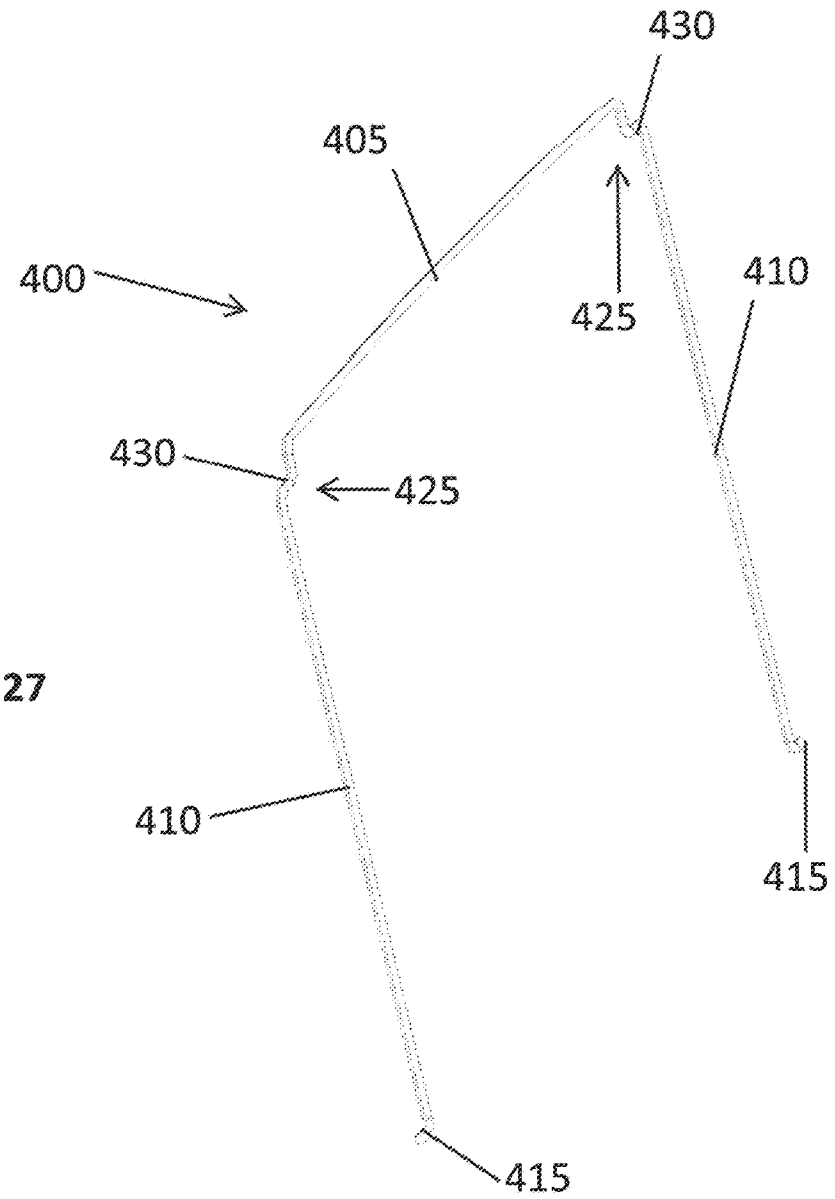
FIG. 27 is a perspective view of the wing support.
Figure 28:
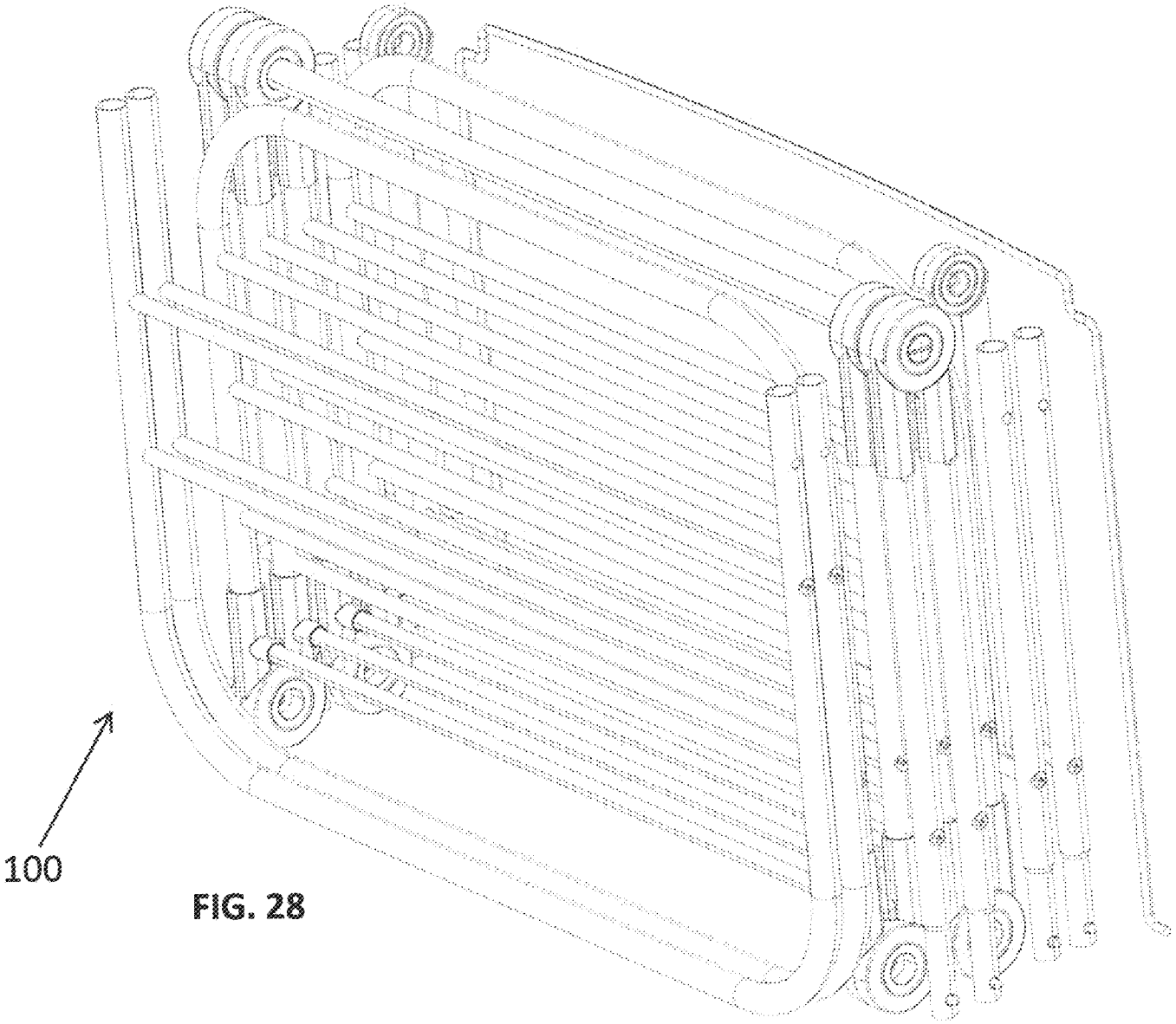
FIG. 28 is a perspective view of the clothes rack in a fully collapsed transportable configuration.
Figure 29:
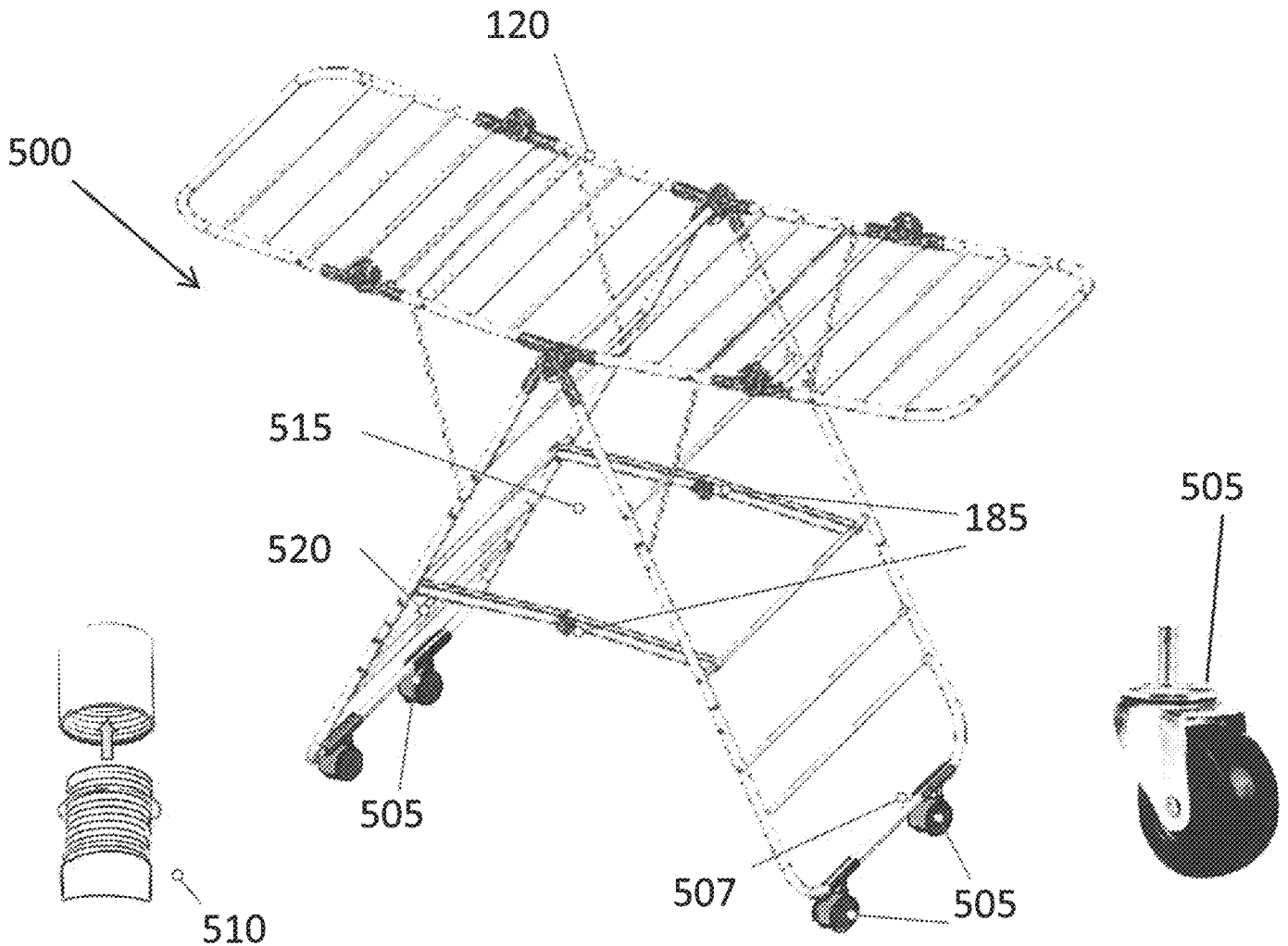
FIG. 29 is an alternative embodiment of the clothes rack showing the use of caster wheels.
Figure 30:
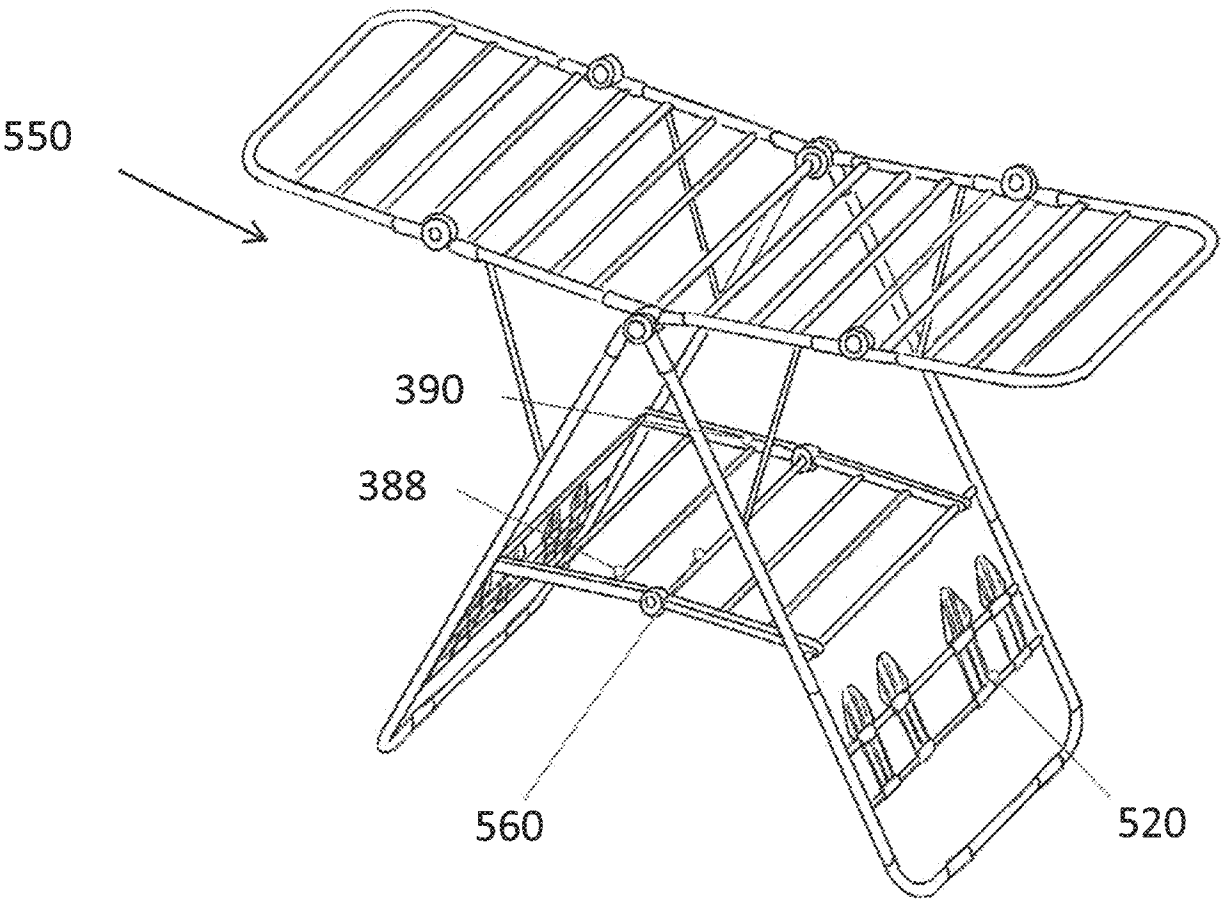
FIG. 30 is an alternative embodiment of the clothes rack showing the use of side shoe racks.

Referring to FIGS. 1 through 30, a folding collapsible clothes rack 100 in accordance with the present invention is shown. The clothes rack 100 is comprised of a lateral center bar 110 (extending front to back). The center bar is secured at each of its ends 112 to a center hinge assembly 115. Extending transversal to the lateral center bar (extending side to side) are foldable wing assemblies 150 and 155. Each foldable wing assembly (150 and 155) are formed from hinge assemblies and wing sections explained from a single side, however, it is configured that each side is substantially similar to each other; such that repetitive descriptions of each side is not necessary.

The pair of center hinge assemblies 115 attaches in each side direction to a first wing assembly 120, which thus extends transversal—extending side to side—from the lateral center bar. The center hinge assemblies 115 are secured about an interior portion 125 of the inside wing assembly 120. The inside wing assembly 120 further includes an exterior portion 130 connected to a pair of outside or first wing hinge assemblies 135. The first wing hinge assemblies 135 further connect to an outside wing assembly 140.

The center hinge assemblies 115 also attach to collapsible main leg assemblies 160 extending downwardly from the center hinge assemblies and extending at an angle θ from the each other. Each main leg assembly 160 includes an upper leg assembly 170, a middle leg assembly 180 and a bottom leg assembly 190. A leg support assembly 185 is provided about the middle leg assembly 180 and secured between the two main leg assemblies 160 for support. The main leg assemblies can be secured to each other with fasteners or internal push pins (discussed herein below).

Continuing to refer to the figures, the sectional and hinge assemblies will be discussed in greater detail. As configured above, the lateral center bar 110 extends front to back with a pair of distal ends 112. The distal ends 112 are secured to central openings 200 defined in the center hinge assembly 115. Fasteners 205 are used to secure the distal ends of the lateral center bar 110 to the center hinge assemblies 115. Each one of the center hinge assemblies 115 are comprised of hinge members 210. Each hinge member 210 includes a circular hub 215 with an extending cylindrical tube 220 hollowed to receive an end of a post (defined below). The hinge members 210 are paired such that two are configured to extend to connect to the inside wing assemblies 120 (referred to also as side hinge members 210A) and two are configured to extend downwardly to connect to the leg assemblies (referred to also as downward hinge members 210B). In addition, each of the hinge members 210 includes an over-flange member 225 positioned adjacent to a portion of an edge of the circular hub 215. The over-flange member 225 includes an arcuate edge 227 that rests against the circular hub 215 of its pair this help restrict over twisting of the hinges.

As noted, one pair of hinge members 210 (side hinge members 210A) from each center hinge assembly 115 are configured to extend at opposing directions to connect to the interior portions 125 of the first wing assemblies 120. Each of the first wing assemblies 120 are configured to include a pair of outside first wing posts 230 and a plurality of first wing lateral cross bars 235 secured therebetween. The pair of outside first wing posts 230 include interior ends 127 connecting to the center hinge assemblies 115, and further include exterior ends 129 distal to the interior ends 127 and configured to connect to the first wing hinge assemblies 135.

Each one of the first wing hinge assemblies 135 are comprised of a pair of first hinge members 250. Each first hinge member 250 includes a circular hub 255 with an extending cylindrical tube 260, hollowed to receive an end of a post. The cylindrical tube 260 further includes a lateral opening 262 to receive a lateral first wing hinge support bar 280. Each of the first hinge members 250 further includes an over-flange member 265 positioned adjacent to a portion of an edge of the circular hub 255. The over-flange member 265 includes an arcuate edge 267 that rests against the circular hub 255 to restrict over twisting of the hinges. In addition, the circular hub 255 is configured to include radial ribs 270 to divide the circular hub 255 into sections, where one of the sections includes at least two to three arcuate cross ribs 275 positioned between two of the radial ribs 270.

The outside wing assembly 140 include an outside U-shaped support bar 300, having a pair of post legs 302 and post end 305 configured to be received into the cylindrical tubes 260 of the first wing hinge assemblies 135. In addition, a plurality of outside wing lateral cross bars 310 are secured between the post legs 302.

As noted above, the center hinge assemblies 115 also attach to collapsible main leg assemblies 160, which extend downwardly from the center hinge assemblies 115 and which extend at an angle θ from the each other. Each main leg assembly 160 includes an upper leg assembly 170, a middle leg assembly 180 and a bottom leg assembly 190. A leg support assembly 185 is provided about the middle leg assembly 180 and secured between the two main leg assemblies 160 for support. The upper, middle, and bottom leg assemblies can be secured to each other with fasteners or internal push pins (discussed herein below). The main leg assemblies 160 are secured to each other to form a V shaped support.

The upper leg assembly 170 consisted of a pair of upper leg posts 172 with a lateral upper leg bar 178 secured between the pair of upper leg posts 172. Each of the upper leg posts 172 include a first top end 174 received by the downward hinge members 210B defined by the center hinge assemblies 115 and include a second bottom end 176. The second bottom end 176 of the upper leg posts 172 taper to a smaller profile configured to slide and fit into the top end 184 of the middle leg assembly 180.

The middle leg assembly 180 consists of a pair of middle leg posts 182 with a lateral middle leg bar 188 secured between the pair of middle leg posts 182. Each of the middle leg posts 182 includes a middle top end 184 hollowed to receive the second bottom end 176 of the upper leg assembly 170. The middle leg posts 182 further include a second bottom end 186 which includes a tapered end configured to slide and fit into the top end 194 of the lower leg assembly 190.

The lower leg assembly 190 includes a U-shaped base member 192 with a pair of lower leg posts 193. Each lower leg post includes an upper lower leg end 194 sized to receive the second bottom middle end 186 of the middle leg posts 182. The lower leg assembly 190 further include one or more lateral lower leg bars 198.

To provide for an easy assembly and disassembly of the leg assemblies 160, internal push pins 200 are provided to connect the lower second bottom end 176 to the middle top ends 184 of the middle leg assembly 180. Opening 320 are provided in the ends which align when assembled. The push pin 350 is a v shaped spring 355 with a knob 360 that protrudes through the aligned openings 320. The v shaped spring biases the knob out of the openings. The user simply has to push the knob through the opening when dissembling the leg assemblies 160.

The leg support assembly 185 extends between the two main leg assemblies 160 by securing about the lateral middle leg bar 188 defined the middle leg assembly 180. The leg support assembly 185 includes a pair of leg support hinges 380 with a circular hub hinge 385 with an extending arm 390. The arm end 390 includes an opening 395 sized to receive the middle leg bar 188. The circular hub hinge 385 includes an over-flange member 387 positioned adjacent to a circular hub hinge 385 to restrict over twisting of the hinge.

In addition to the above, the folding collapsible clothes rack 100 may include wing supports 400. The wing supports are U shaped supports that connect to the middle leg assemblies 180 and extend upwardly to support the first wing assemblies 120 towards the first wing hinge assemblies 135. The U-shaped supports 400 include legs 410 extending from a U-shaped base 405. The legs 410 include leg tips 415 extending outwardly to fit into apertures 420 on the middle leg assemblies 180. The U-shaped base 405 includes shoulders 425 that connect to the legs 410. The shoulders include an outwardly L shaped indentation 430. The indentations 430 rest against the pair of outside first wing posts 230.

In another embodiment, the clothes rack 500 includes wheel holders 507 to receive caster wheels 505. In addition, the leg support assembly 185 may include a mesh netting 515 and a shoe rack 520. Alternatively, the leg support assembly 185 may include additional lateral supports 388 and a centered lateral support 560.

By utilizing the above configuration, a collapsible folding clothes rack can be economically provided to end users by providing it to them in a partially assembled configuration. In view of the above, it will be seen that several advantages of the present invention have been achieved and other advantageous results have been obtained. From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A folding collapsible clothes rack comprising:

a lateral center bar extending from a front to a back of the clothes rack and having ends distal to each other, each end being attached to a center hinge assembly;

a pair of foldable wing assemblies attached to the center hinge assemblies and extending transversal to the lateral center bar;

a pair of collapsible main leg assemblies each attached to the center hinge assemblies, and wherein the center hinge assemblies being configured to pivot the main leg assemblies to a predetermined angle from each other to define a base on a surface;

a leg support assembly secured between the pair of collapsible main leg assemblies, and wherein the leg support assembly includes leg support hinges configured to permit the pair of collapsible main leg assembles to pivot away from each other at the predetermined angle;

wherein each of the foldable wing assembly includes:

a first wing assembly extending transversal to the lateral center bar and having sides transversally distal to each other, the first wing assembly being secured at one of the sides to the center hinge assemblies and secured at the other side to a pair of first wing hinge assemblies;

an outside wing assembly extending transversal to the lateral center bar and having sides transversally distal to each other, the outside wing assembly being secured at one of the sides to the pair of first wing hinge assemblies and having a U-shaped end at the other side; and wherein the pair of first wing hinge assemblies are configured to pivot and maintain the outside wing assemblies in various planes angled from the first wing assemblies, including a plane substantially parallel to the first wing assemblies, a plane angled upwardly from the first wing assemblies, and a plane substantially overlapping the first wing assembles; and a pair of outside first wing posts and a plurality of first wing lateral cross bars secured therebetween, and each of the pair of outside first wing posts include a first wing interior end configured to connect to the center hinge assemblies, and further include a first wing exterior end distal to the first wing interior end and configured to connect to the pair of first wing hinge assemblies; and wherein the pair of first wing hinge assemblies further include:

a front first wing hinge assembly and a rear first wing hinge assembly, each of the front and rear first wing hinge assemblies include a pair of first hinge members, each first hinge member has a circular hub with an extending cylindrical tube hollowed to receive an end of a post, the cylindrical tube further includes a lateral opening, a pair of lateral first wing hinge support bars secured in the lateral openings and extending between the front and rear first wing hinge assemblies, and wherein each of the first hinge members further includes an over-flange member configured when assembled to prevent over twisting of the hinges, and wherein each of the circular hubs in the front and rear first wing hinge assemblies are configured to include radial ribs to divide the circular hub into sections, and where one of the sections includes at least two arcuate cross ribs positioned between two of the radial ribs.

2. The clothes rack of claim 1, wherein each one from the pair of collapsible main leg assemblies includes:

an upper leg assembly, a bottom leg assembly, and a middle leg assembly removably attached at one end to the upper leg assembly and removably attached at the other end to the bottom leg assembly.

3. The clothes rack of claim 2, wherein the leg support assembly is secured between the two middle leg assemblies defined on either one of the pair of main leg assemblies.

4. The clothes rack of claim 1, wherein the center hinge assemblies each are further defined to include:

a central opening to receive an end of the lateral center bar;

four hinge members, each defined to include a circular hub with an extending cylindrical tube hollowed to receive an end of a post, the four hinge members are paired to configure one pair extending transversally to connect to the pair of foldable wing assemblies and a second pair extending downwardly to connect to the collapsible main leg assemblies; and wherein each of the hinge members includes an over-flange member configured adjacent to an edge of its circular hub such that when assembled the over-flange members on a paired hinge member restrict movement to prevent over twisting of the hinges.

5. The clothes rack of claim 1, wherein each of the outside wing assemblies include:

an outside U-shaped support bar having a pair of outside wing post legs and outside wing post end configured to secure to the first wing hinge assemblies; and a plurality of outside wing lateral cross bars secured between the post legs.

6. The clothes rack of claim 2, wherein the upper leg assembly includes:

a pair of upper leg posts with at least one lateral upper leg bar secured between the pair of upper leg posts, and wherein each of the upper leg posts includes an upper leg first end configured to secure to the center hinge assembly and further includes an upper leg second end, and wherein the upper leg second end tapers to a smaller cylindrical profile such that the upper leg second end secures into a defined middle leg first end on the middle leg assembly.

7. The clothes rack of claim 6, wherein the middle leg assembly includes:

a pair of middle leg posts with at least one lateral middle leg bar secured between the pair of middle leg posts, and wherein each of the middle leg posts includes the middle leg first end, and a middle leg second end, wherein the middle leg second end tapers to a smaller cylindrical profile such that the middle leg second end secures into a defined lower leg first end on the lower leg assembly.

8. The clothes rack of claim 7, wherein the lower leg assembly includes:

a U-shaped base member with a pair of lower leg posts and at least two lateral lower leg bars secured between the pair of lower leg posts, and wherein each of the lower leg posts includes the lower leg first end.

9. The clothes rack of claim 1, wherein the leg support assembly includes: a pair of the leg support hinges with a circular hub hinge and an extending arm, the extending arm includes an arm end with an opening sized to receive a lateral middle leg bar, and wherein the circular hub hinge includes an over-flange member positioned adjacent to the circular hub hinge to restrict over twisting of the hinge.

10. The clothes rack of claim 2 further comprising:

a wing support on either side of the clothes rack, the wing supports are U shaped supports and configured to connect to the middle leg assemblies and extend upwardly to support the pair of foldable wing assemblies.

11. The clothes rack of claim 1 further comprising four separate wheel holders secured about a lower end of the main leg assemblies, each wheel holder configured to receive a caster wheel.

* * * * *